United States Patent [19]

Ishibashi et al.

[11] 4,258,127

[45] Mar. 24, 1981

[54] REVERSAL COLOR DEVELOPMENT PROCESS

[75] Inventors: Hiroshi Ishibashi; Haruhiko Iwano, both of Minami-ashigara, Japan

[73] Assignee: Fuji Photo Film Co., Ltd., Minami-ashigara, Japan

[21] Appl. No.: 627,821

[22] Filed: Oct. 31, 1975

[30] Foreign Application Priority Data

Oct. 31, 1975 [JP] Japan ..... 50-126240

[51] Int. Cl.[3] ..... G03C 7/16

[52] U.S. Cl. ..... 430/379; 430/382; 430/410; 430/447; 430/449; 430/544

[58] Field of Search ..... 96/22, 59, 55, 50, 10, 96/95

[56] References Cited

U.S. PATENT DOCUMENTS

| | | | |
|---|---|---|---|
| 3,246,987 | 4/1966 | Hanson et al. | 96/22 |
| 3,841,877 | 10/1974 | Willems et al. | 96/95 |
| 3,938,996 | 2/1976 | Fujiwhara | 96/95 |
| 3,977,879 | 8/1976 | Bigelow | 96/95 |

*Primary Examiner*—Travis Brown

*Attorney, Agent, or Firm*—Sughrue, Rothwell, Mion, Zinn and Macpeak

[57] ABSTRACT

In a reversal color development process including a black and white development and a color development, the sharpness, granularity and multilayer effect of the color photographic images formed are remarkably improved by subjecting silver halide reversal color photographic materials to black and white development in the presence of a DIR compound, i.e., a non-coupler type compound capable of releasing a development inhibitor upon development, processing the color photographic materials in an aqueous solution of a fogging agent, and then subjecting the color photographic materials to color development.

10 Claims, No Drawings

REVERSAL COLOR DEVELOPMENT PROCESS

BACKGROUND OF THE INVENTION

1. Field of the Invention

The present invention relates to a reversal color development process. More particularly, the invention relates to a reversal color photographic process for providing color photographic images having an improved multilayer effect, granularity, and sharpness.

2. Description of the Prior Art

A reversal color development process for multilayer silver salt color photographic materials is described in, for example, C. E. K. Mees, *The Theory of the Photographic Process,* 2nd, Ed., Paragraph 25, 1954. As such a development process, there are generally two systems: a reversal development process wherein the color development is carried out with couplers in the photographic emulsion layers of color photographic materials; and a reversal development process wherein the color development is carried out with couplers in the developer. In both systems, processing is composed of the following steps.

An exposed color photographic material is subjected to a first development using a black and white developer, whereby silver salt in exposed areas is reduced to form a negative image. Then, the photographic material is subjected to color development, whereby unexposed silver halide which was not reduced in the first development is developed to form developed silver and, at the same time, oxidized color developing agent is caused to react with couplers to form a positive color image. Thereafter, silver is removed in a silver removal step to leave a sharp dye image on the support of the color photographic material. The silver removal step may be a bleach step to convert developed silver to a water-soluble or water-insoluble silver salt by oxidizing it and a fix step to dissolve the water-soluble silver salt or to convert the water-insoluble silver salt to a water-soluble silver complex salt followed by dissolution of the water-soluble silver complex salt or, alternatively, may be a blix step which accomplishes the bleach step and the fix step in one step.

In any case, the first development (or black and white development), color development, and silver removal are the fundamental steps of a reversal color development but the process may further include, if desired, auxiliary steps such as a stopping, a hardening, a stabilization, etc.

The reversal development of the type where the color development is carried out with couplers in the developer includes a cyan development, a yellow development, and a magenta development, and each color developer contains the corresponding coupler therein. On the other hand, in the reversal development of the other type, the color photographic material contains the couplers in its photographic emulsion layers.

One of the important concepts of the latter type of reversal color development is to effectively perform the second development (color development), and for this purpose a chemical fogging is usually employed after the first development of the color photographic material instead of a light fogging. In order to perform chemical fogging, ethylene diamine, n-butylamine, an alkali metal salt of borohydride, amine borane, etc., are added alone or as a mixture thereof to the second developer or color developer as a fogging agent.

On the other hand, a technique has recently been utilized where a development inhibitor is released from the developed layer containing it as the development progresses, and the development of an adjacent photographic emulsion layer is inhibited to give the multilayer effect or the development of the layer containing the development inhibitor or the layer adjacent thereto is inhibited to give fine granularity. A compound which releases a development inhibitor in the development reaction is called "development inhibitor releasing compound" or a "DIR compound;" such a compound may be a coupler, a developing agent, or a material which releases an inhibiting compound upon development.

Since such DIR compounds are used in color photographic negative materials, it might be considered obvious to utilize DIR compounds in reversal color development to obtain an improved multilayer effect and fine granularity, but the practical application of this technique encounters problems. That is, the effect of the DIR couplers used in the first development also affects the subsequent steps to inhibit a sufficient color development. This phenomenon is also observed in a color developer containing a fogging agent, as mentioned above. Therefore, it has been difficult with conventional techniques to use DIR materials with color negative materials in reversal color photographic systems for industrial or commercial purposes. Even if the DIR couplers are used in reversal color photographic materials, they can be used only in the range which does not inhibit the color development, and hence their effect is low.

If the remarkable effect of DIR compounds in negative color development could be achieved in reversal color processing, the quality of the color images would be markedly improved.

The application of DIR couplers to development processes for reversal color photographic materials also encounters problems in granularity and color image sharpness, i.e., when the color development is inhibited, it is observed that the granularity of color images formed is roughened to reduce the sharpness thereof. The reason for this effect is not completely clear, but it is believed that if a development inhibitor is strongly adsorbed around silver salt grains, the number of development initiation points is lessened and the dyes formed concentrate around the development initiation points, which results in an enlarging of dense dye distribution points to coarsen the granularity and reduce the sharpness of the color images. From this viewpoint, the use of DIR compounds in reversal color photographic development actually decreases image quality.

SUMMARY OF THE INVENTION

One object of this invention is, therefore, to provide a reversal color photographic process which effectively utilizes DIR compounds without any harmful influence on the color development, i.e., one object of this invention is to provide a novel reversal color photographic development process which can be performed not only with an increase in the multilayer effect of the DIR compounds employed therein but also without any coarsening of the granularity of the color images or a reduction in the sharpness of the images heretofore considered peculiar to conventional reversal color development when a development inhibition effect has been achieved.

A specific object of this invention is to provide a reversal color development process which remarkably improves the multilayer effect of reversal color photographic materials of the type containing couplers in the photographic emulsion layers of the photographic materials, and also to provide color photographic images having improved granularity and sharpness.

The above-mentioned objects of this invention are attained by the process of this invention, i.e., a reversal color photographic development process including a first development and a color development, which comprises subjecting a reversal color photographic material to the first development in the presence of a non-coupler type compound capable of releasing a development inhibiting material, processing the photographic material thus developed with an aqueous solution of a reducing compound capable of chemically fogging the silver halide of the photographic material, and then subjecting the photographic material to color development.

DESCRIPTION OF THE PREFERRED EMBODIMENTS

By the practice of the reversal color development process of this invention, reversal color photographic materials sufficiently exhibit a multilayer effect and further color photographic images having improved granularity and sharpness are obtained. Furthermore, as will be understood from the examples below, when DIR compounds are used in conventional reversal color process, the granularity and sharpness of the color photographic images obtained are reduced. Also, when a fogging bath is employed in a conventional reversal color development process, little improvement in granularity and color image sharpness is achieved. However, by combining both of the aforesaid techniques, i.e., the use of DIR compounds and a fogging bath, unexpectedly better results are obtained, i.e., the harmful influence of the DIR compounds on reversal color development is removed in the fogging bath and thus the DIR compounds provide the excellent effects of improving granularity and sharpness of color photographic images as in negative color photographic development.

In the process of this invention the DIR compounds can be incorporated in the first developer (black and white developer) or can be incorporated in one or more silver halide emulsion layers of the color photographic materials. The DIR compounds release a development inhibiting compound upon development and possess the property that the compound does not form a dye upon color development (in this point, a DIR compound is distinguishable from a DIR coupler). Such DIR compounds are described in U.S. Pat. Nos. 3,297,445, 3,364,022, 3,379,529 and 3,639,417, and Japanese patent application Nos. 41870/1973, 73445/1973, 103542/1973, 110703/1973, 143291/1973, 25482/1974, and 39662/1974. The DIR compounds described in these patents or patent applications can be used in this invention.

In the present invention any conventional developing agent can be used under any conventional black and white development conditions.

Particularly preferred DIR compounds used in the process of this invention are hydroquinone compounds. There are basically two types of hydroquinone compounds as such DIR compounds. One type of hydroquinone compound is a compound which directly releases a diffusible mercapto development inhibitor upon development of silver halide grains or releases a diffusible mercapto development inhibitor upon reaction with the oxidation product of a color developing agent formed upon the development of silver halide, and the other type of hydroquinone compound is a compound which similarly releases an iodine ion.

The DIR compounds which release mercapto development inhibitors as described above include the compounds represented by general formula (I):

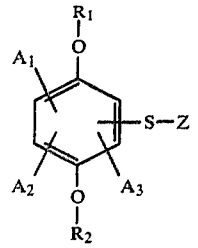

(I)

wherein $R_1$ and $R_2$ each represents a hydrogen atom or a group capable of being released from the compounds of formula (I) in an alkaline solution to form hydroquinone (for instance, an acetyl group, chloroacetyl group, dichloroacetyl group, monofluoroacetyl group, difluoroacetyl group, trifluoroacetyl group, pyridyl group, alkoxyallyl group, alkoxycarbonyl group, nitrobenzoyl group, cyanobenzoyl group, etc.); $A_1$, $A_2$ and $A_3$ each represents a hydrogen atom, a group which renders the compound diffusible, oil-soluble, and water-soluble and which increases the activity of hydroquinone (i.e., the development activity of the hydroquinone is increased by the substituent when the DIR compound is released from the compound of formula (I)), such as an alkyl group having 1 to 20 carbon atoms, an alkoxy group, an aryloxy group, a hydroxyl group, an aryl group (e.g., phenyl group, tolyl group, xylyl group, etc.), an aralkyl group, a halogen atom (e.g., chlorine atom, bromine atom, iodine atom, fluorine atom, etc.), a heterocyclic group, preferably with 3 to 11 carbon atoms (e.g., tetrazolyl group, thiazolyl group, etc.), or an S-Y residue (in which Y is an alkyl group having 1 to 18 carbon atoms (e.g., a 2-ethylhexyl group, an n-dodecyl group, a hexadecyl group, an n-octadecyl group, a hydroxycarbonyl, an ethoxycarbonylmethyl group, a 2-hydroxyethyl group, etc.) or an aryl group (e.g., a phenyl group, etc.)) or an S-Z group where Z is as later defined; and Z represents a heterocyclic residue, preferably with 3 to 11 carbon atoms, which is substantially photographically inert in the bonded state (where the S-Z group is bonded to the compound of formula (I)), such as, in particular, a tetrazolyl group (e.g., 1-phenyltetrazolyl group, etc.), a triazolyl group (e.g., 4-phenyl-1,2,4-triazole-5-yl group, 3-n-pentyl-4-phenyl-1,2,4-triazole-5-yl group, etc.), a thiazolyl group (e.g., 2-methylthio-1,3,4-thiazole-5-yl group, 2-amino-1,3,4-thiazole-5-yl group, etc.), an oxadiazolyl group (e.g., 2-phenyl-1,3,4-oxadiazole-5-yl group, etc.), a tetraazaindenyl group (e.g., 6-methyl-1,3,3a,7-tetraazaindene-4-yl group, 6-n-nonyl-1,3,3a,7-tetraazaindene-4-yl group, etc.), an oxazolyl group (e.g., benzoxazole-2-yl group, etc.), and a thiazolyl group (e.g., benzothiazole-2-yl group, etc.). In particular, $A_1$ is preferably an -S-Z residue.

In the above-described formula, it is preferred that $A_1$, $A_2$, or $A_3$ contain a ballasting group, and further it is particularly preferred that $R_1$ and $R_2$ be a hydrogen atom, $A_1$, $A_2$, and $A_3$ be hydrogen or an alkyl group.

In order to render the DIR compounds and couplers shown below diffusion resistant, a hydrophobic residue or ballasting group, as such is commonly called in the art, having 8 to 32 carbon atoms is introduced into the molecule of the DIR compound and the coupler. The ballast group can be bonded to the skeleton structure of the DIR compound or the coupler directly or through an imino bond, an ether bond, a carbonamido bond, a sulfonamido bond, a ureido bond, an ester bond, an imido bond, a carbamoyl bond, or a sulfamoyl bond.

Specific examples of the ballast groups used in this invention are as follows:

(I) Alkyl groups and alkenyl groups: for instance, $-CH_2-CH(C_2H_5)_2$, $-C_{12}H_{25}$, $-C_{16}H_{33}$, and $-C_{17}H_{33}$.

(II) Alkoxyalkyl groups: for instance, $-(CH_2)_3-O-(CH_2)_7CH_3$, and $$-(CH_2)_3OCH_2-\underset{\underset{C_2H_5}{|}}{CH}-(CH_2)_8-CH,$$

as described in Japanese Patent Publication 27563/1964.

(III) Alkylaryl groups: for instance,

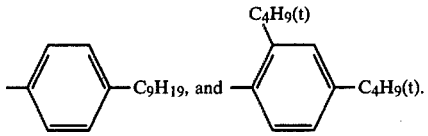

(IV) Alkylaryloxyalkyl groups: for instance,

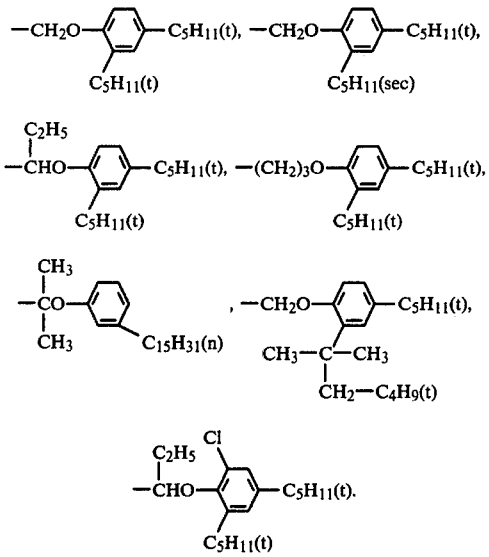

(V) Acylamidoalkyl groups: for instance,

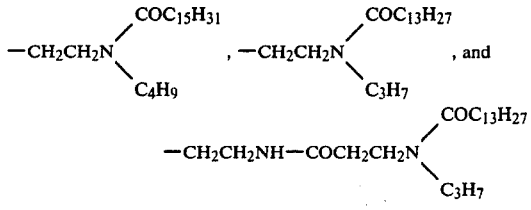

as described in U.S. Pat. Nos. 3,337,344 and 3,418,129.

(VI) Alkoxyaryl groups and aryloxyaryl groups: for instance,

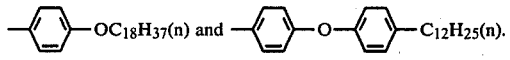

(VII) Residues comprising an alkyl or alkenyl long-chain aliphatic group and a carboxyl or sulfo (water-solubilizing) group: for instance, $$-\underset{\underset{CH_2COOH}{|}}{CH}-CH=CH-C_{16}H_{33} \text{ and } -\underset{\underset{SO_3H}{|}}{CH}-C_{16}H_{33}.$$

(VIII) Alkyl groups substituted with an ester group: for instance, $$-\underset{\underset{COOC_2H_5}{|}}{CH}-C_{16}H_{33}(n) \text{ and } -CH_2-CH_2-COOC_{12}H_{25}(n).$$

(IX) Alkyl groups substituted with an aryl group or a heterocyclic group: for instance,

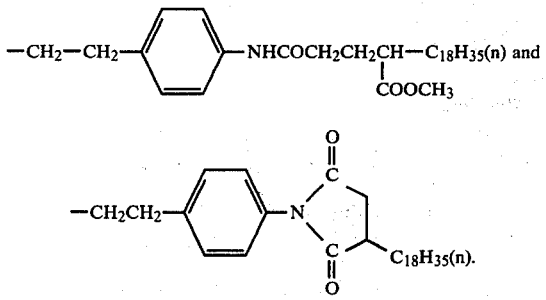

(X) Aryl groups substituted with an aryloxyalkoxycarbonyl group: for instance,

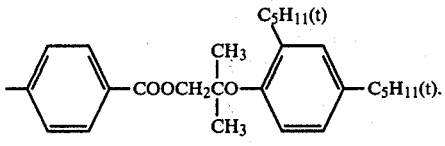

Specific examples of compounds represented by general formula (I) are given below:

Compound 1

2-n-dodecylthio-5-(1'-phenyltetrazole-5'-yl-thio)hydroquinone

Compound 2

2-n-octadecylthio-5-(1'-phenyltetrazole-5'-yl-thio)hydroquinone

Compound 3

2-n-hexadecylthio-5-(1'-phenyltetrazole-5'-yl-thio)-hydroquinone

Compound 4

2-[2',5'-dihydroxy-6'-(1''-phenyltetrazole-5''-yl-thio)-4'-(1''',1''',3''',3'''-tetramethylbutyl)]phenylthiobenzoic acid Compound 5

2-[2',5'-dihydroxy-6'-(1''-phenyltetrazole-5''-yl-thio)-3'-(1''',1''',3''',3'''-tetramethylbutyl)]phenylthiobenzoic acid Compound 6

2-(1'-phenyltetrazole-5'-yl-thio)-3-phenylthio-6-(1'',1'',3'',3''-tetramethylbutyl)hydroquinone
Compound 7
2-(1'-phenyltetrazole-5'-yl-thio)-3-phenylthio-5-(1'',1'',3'',3''-tetramethylbutyl)hydroquinone
Compound 8
2,5-dihydroxy-5-[1'-phenyltetrazole-5'-yl-thio)-4-(1'',1'',3'',3''-tetramethylbutyl)]phenylthioacetic acid
Compound 9
2-[2',5'-dihydroxy-3'-n-hexadecylthio-6'-(1''-phenyltetrazole-5''-yl-thio)]phenylthiobenzoic acid
Compound 10
2-n-hexadecylthio-5-(1'-phenyltetrazole-5'-yl-thio)-6-phenylhydroquinone
Compound 11
4-(1'-phenyltetrazole-5'-yl-thio)-5-hydroxy-7-(1'',1'',3'',3''-tetramethylbutyl)benzoxathiole-2-one
Compound 12
2-[2',5'-dihydroxy-6'-(1''-phenyltetrazole-5''-yl-thio)-3'-(1''',1''',3''', 3'''-tetramethylbutyl)]phenylthiobenzoic acid methyl ester
Compound 13
2-[2',5'-dihydroxy-6'-(1''-phenyltetrazole-5''-yl-thio)-4'-(1''',1''',3''',3'''-tetramethylbutyl)]phenylthiobenzoic acid methyl ester
Compound 14
2-[2',5'-dihydroxy-3'-n-penadecylthio-6'-(1''-phenyltetrazole-5''-yl-thio)]phenylthiobenzoic acid methyl ester
Compound 15
2-n-octyloxycarbonylmethylthio-6-phenyl-3-(1'-phenyltetrazole-5'-yl-thio)hydroquinone
Compound 16
2-p-nitrophenylthio-3-(1'-phenyltetrazole-5'-yl-thio)-6-(1'',1'',3'',3''-tetramethylbutyl)hydroquinone
Compound 17
2-(2'-methylthio-1',3',4'-thiadiazole-5'-yl-thio)-6-(1'',1'',3'',3''-tetramethylbutyl)hydroquinone
Compound 18
3-(2'-methylthio-1',3',4'-thiadiazole-5'-yl-thio)-6-(1'',1'',3'',3''-tetramethylbutyl)hydroquinone
Compound 19
2,3-bis(2'-methylthio-1',3',4'-thiadiazole-5 '-yl-thio)-6-(1'',1'',3'',3''-tetramethylbutyl)hydroquinone
Compound 20
2-(3'-pentyl-4'-phenyl-1',2',4'-triazole-5'-yl-thio)-5-(1'',1'',3'',3''-tetramethylbutyl)hydroquinone
Compound 21
2-(6'-methyl-1',3',3*a*',7'-tetraazaindene-4'-yl-thio)-6-(1'',1'',3'',3''-tetramethylbutyl)hydroquinone
Compound 22
2,3-bis(6'-methyl-1',3',3*a*',7'-tetraazaindene-4'-yl-thio)-1-(1'',1'',3'',3''-tetramethylbutyl)hydroquinone
Compound 23
2-n-hexadecylthio-5-(2'-methylthio-1',3',4'-thiadiazole-5'-yl-thio)hydroquinone
Compound 24
2-[2',5'-dihydroxy-6'-(2''-methylthio-1'',3'',4''-thiadiazole-5''-yl-thio)-3'-(1''',1''',3''',3'''-tetramethylbutyl)]-phenylthiobenzoic acid
Compound 25
2-(2'-amino-1',3',4'-thiadiazole-5'-yl-thio)-5-(1'',1'',3'',3''-tetramethylbutyl)hydroquinone
Compound 26
2-[2',5'-dihydroxy-6'-(2''-amino-1'',3'',4''-thiadiazole-5''-yl-thio)-5-(1''',1''',3''',3'''-tetramethylbutyl)]-phenylthiobenzoic acid
Compound 27
2-(2'-amino-1',3',4'-thiadiazole-5'-yl-thio)-3-n-dodecylthio-6-(1'',1'',3'',3''-tetramethylbutyl)hydroquinone
Compound 28
2-(6'-t-butyl-1',3',3*a*',7'-tetraazaindene-4'-yl-thio)-6-(1'',1'',3'',3''-tetramethylbutyl)hydroquinone
Compound 29
2-(6'-n-nonyl-1',3',3*a*',7'-tetraazaindene-4'-yl-thio)-6-(1'',1'',3'',3''-tetramethylbutyl)hydroquinone
Compound 30
2-(4'-phenyl-1',2',4'-triazole-5'-yl-thio)-2-(1'',1'',3'',3''-tetramethylbutyl)hydroquinone Compound 31
2-(2'-phenyl-1',3',4'-oxadiazole-5'-yl-thio)-5-(1'',1'',3'',3''-tetramethylbutyl)hydroquinone
Compound 32
2-(1'-phenyltetrazole-5'-yl-thio)-5-n-octyloxycarbonylmethylthiohydroquinone
Compound 33
2-t-dodecylthio-5-(1'-phenyltetrazole-5'-yl-thio)hydroquinone
Compound 34
2-(benzoxazole-2'-yl-thio)-5-n-ocadecylhydroquinone
Compound 35
2-(2'-methylphenylthio)-6-n-octadecylthio-3-(1''-phenyltetrazole-5''-yl-thio)hydroquinone
Compound 36
2-n-octyloxycarbonylmethylthio-3-(1'-phenyltetrazole-5'-yl-thio)-6-p-tolylhydroquinone
Compound 37
2-ethoxycarbonylmethylthio-6-n-hexadecylthio-3-(1'-phenyltetrazole-5'-yl-thio)hydroquinone
Compound 38
2-phenylthio-3-(1'-phenyltetrazole-5'-yl-thio)-5-n-dodecylthiohydroquinone
Compound 39
2-methyl-5-(1-phenyl-5-tetrazolylthio)hydroquinone
Compound 40
(1-phenyl-5-tetrazolylthio)trimethylhydroquinone The compounds represented by general formula (I) can be prepared by the method described in U.S. Pat. No. 3,379,529, that is, by the addition reaction of mercapto compounds to benzoquinones.

The compounds which release an iodine ion include the compounds represented by general formula (II):

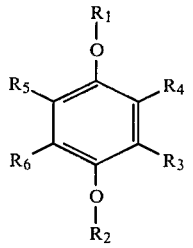

(II)

wherein $R_1$ and $R_2$ have the same meaning as in general formula (I), and $R_3$, $R_4$, $R_5$, and $R_6$ each represents a hydrogen atom, an iodine atom, an alkyl group having 1 to 20 carbon atoms, a hydroxyl group, an amino group, or an aryl group (e.g., phenyl group, tolyl group, xylyl group, etc.); at least one of $R_3$, $R_4$, $R_5$, and $R_6$ being an iodine atom and at least one of the remaining groups of $R_3$ to $R_6$ being a substituent other than a hydrogen atom.

In the aforesaid formula, it is particularly preferred that $R_1$ and $R_2$ be hydrogen, $R_6$ be iodine, and $R_3$, $R_4$, and $R_5$ be substituents other than iodine atom.

Specific examples of compounds of general formula (II) are described in U.S. Pat. No. 3,297,445. Some of them are set out below:

Compound 41
2-iodo-5-pentadecylhydroquinone
Compound 42
2,6-diiodohydroquinone
Compound 43
6-iodo-2,3,5-trimethylhydroquinone
Compound 44
2-iodo-3-methyl-6-isopropylhydroquinone
Compound 45
2-iodo-3,5-dimethyl-6-dodecylhydroquinone
Compound 46
1,4-bis(chloroacetyloxy)-2,6-diiodobenzene When the DIR compound is incorporated in a photographic emulsion, the amount of the compound is usually from about 1/400 to about ½ mol, preferably from 1/10 to 1/100 mol, per mol of the coupler in the emulsion. When the DIR compound is incorporated in the first developer, the compound can be used in a wide range of concentration, but usually the amount of thereof is from about 1/3000 to about 1/10 mol per mol of the developing agent in the developer. In this instance, since a fogging bath is used in this invention, the DIR compound can be used at high concentration and hence the DIR compound is most preferably used in the developer in the range of from 1/200 to 1/20 mol per mol of the developing agent.

In the process of this invention, it is desirable that the DIR compounds be contained in the photographic emulsion layers of color photographic materials. However, the objects of this invention can be sufficiently attained when the DIR compounds are incorporated in the first developer (black and white developer). Furthermore, as the case may be, color photographic materials containing a DIR compound or compounds in the photographic emulsion layer(s) thereof can be processed in a first developer containing a DIR compound or compounds.

The fogging bath used in this invention is conventional, and can contain various known fogging agents. For instance, typical examples of the fogging agents are alkali metal salts (e.g., sodium salt, potassium salt, lithium salt, etc.) of borohydride; compounds of the formula $YBH_3$ (wherein Y represents ammonia or an amine, for instance, an alkylamine such as methylamine, dimethylamine, triethylamine, ethylamine, ethanolamine, diethylamine, triethylamine, diethanolamine, propylamine, dipropylamine, butylamine, sec-butylamine, t-butylamine, and amylamine; a polyamine such as ethylenediamine, diethylenetriamine, etc.; an aromatic amine such as aniline, etc.; an aromatic amine such as pyridine and lutidine; and a phosphine such as hydrazine, methylphosphine, and ethylphosphine); the compounds shown by the formula:

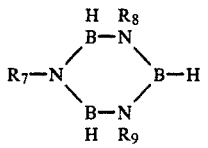

(wherein $R_7$, $R_8$, and $R_9$ each represents a hydrogen atom; a halogen atom such as chlorine atom, bromine atom, iodine atom, fluorine atom, etc.; an alkyl group such as methyl group, ethyl group, propyl group, etc.; or an alkoxy group such as methoxy group, ethoxy group, propoxy group, etc.); the polyborohydrides of the formula $(L_{+n})_x(B_yH_z)^{-nx}$ (wherein L represents an n-valent cation where n is an integer greater than 1, x is an integer greater than 1, y is an integer greater than 2, and z is an integer greater than 4, it being specifically preferred that n is 1–3, x is 1 or 2, y is 2–20, and z is 6–14); the stannous complex salts of aminocarboxylic acids (e.g., nitrilotriacetic acid, ethylenediaminetetraacetic acid, diethylenetriaminepentaacetic acid, ethyleneglycolbis(aminoethylether)tetraacetic acid, diaminopropanoltetraacetic acid, N-hydroxyethyl ethylenediamineteraacetic acid, ethyliminodipropionic acid, and cyclohexanediaminotetraacetic acid); hydrazine compounds (e.g., phenylhydrazine and naphthylhydrazine); the stannous chelate compounds of organic phosphorus compounds shown by the formula $R_{10}N(CH_2PO_3M_2)_2$ or $R_{10}R_{11}C(PO_3M_2)_2$ (wherein M represents a hydrogen atom; an alkali metal atom such as sodium atom, potassium atom, or lithium atom; an ammonium group; or a pyridinium group, $R_{10}$ represents an alkyl group having 1 to 4 carbon atoms such as methyl group, ethyl group, propyl group, and n-butyl group; an aryl group such as phenyl group, o-tolyl group, m-tolyl group, p-tolyl group, o-carboxyphenyl group, and p-carboxyphenyl group; or an aralkyl group such as a benzyl group, and $R_{11}$ represents a hydrogen atom; an alkyl group having 1 to 4 carbon atoms such as methyl group, ethyl group, propyl group, and n-butyl group; or a group of the formula $PO_3M_2$ where M is as defined above).

Specific examples of fogging agents used in this invention are as follows:

Sodium borohydride,
Potassium borohydride,
Diethylamineborane,
Triethylamineborane,
trimethylamineborane,
t-Butylamineborane,
Pyridineborane,
2,6-Lutidineborane,
Ethylenediaminediborane,
Hydrazinediborane,
Dimethylphosphineborane,
Dimethylstibinborane,
Borazine,
N,N′,N″-trimethylborazine,
N,N′,N″-trimethoxyborazine,
Tetramethylammonium octahydrotriborate,
Ditetramethylammonium hexahydrodiborate,
Di-tetramethylammonium tetradecahydrodecaborate,
Trimethyloctadecylammonium octahydrotriborate,
Pyridinium octahydrotriborate,
Tetramethylphosphonium octahydrotriborate,
Trimethylsulfonium octahydrotriborate,
Disodium hexahydrodiborate,
Disodium tetradecahydrodecaborate,
Stannous ethylenediaminetetraacetate.disodium salt,
Stannous nitrilotriacetate.sodium salt,
Tin N-hydroxyethylenediamine triacetate,
Tin iminodiacetate,
Chelate compound of tin (II) and ethylenediamine-N,N,N′,N′-tetramethylenephosphonic acid, Chelate compound of tin (II) and nitrilo-N,N,N-trimethylenephosphonic acid,
Chelate compound of tin (II) and 1,2-cyclohexanediamine-N,N,N',N'-tetramethylenephosphonic acid,
Chelate compound of tin (II) and propylamino-N,N-dimethylenehosphonic acid,
Chelate compound of tin (II) and 4-(pyrrolidino)-butylamine-N,N-bis(methylenephosphonic acid),
Chelate compound of tin (II) and 1,3-diaminopropanol-N,N,N',N'-tetramethylenephosphonic acid,
Chelate compound of tin (II) and 1,3-propanediamine-N,N,N',N'-tetramethylenephosphonic acid,
Chelate compound of tin (II) and o-acetamidobenzylamino-N,N-dimethylenephosphonic acid,
Chelate compound of tin (II) and 2-pyridylamino-N,N'-dimethylenephosphonic acid,
Chelate compound of tin (II) and o-toluidine-N,N-dimethylenephosphonic acid,
Chelate compound of tin (II) and 1-hydroxyethylidene-1,1-diphosphonic acid,
Chelate compound of tin (II) and ethylidene-1,1,1-triphosphonic acid,
Chelate compound of tin (II) and 1-hydroxypropylidene-1,1-diphosphonic acid,
Ethylenediamineborane, and
Hydrazinediborane.

Examples of the fogging agents are described in U.S. Pat. Nos. 2,984,567, 3,246,987, and 3,554,748.

The fogging bath used in this invention is an alkaline (pH 7–14) aqueous solution of one or more fogging agents. The pH of the fogging bath is adjusted by the addition of one or more conventional alkaline agents such as sodium hydroxide, potassium hydroxide, lithium hydroxide, sodium carbonate, potassium carbonate, sodium tertiary phosphate, potassium tertiary phosphate, sodium metaborate, potassium metaborate, borax, and ammonium hydroxide.

The fogging bath may further contain a water softener such as aminopolycarboxylic acid and polyphosphate and a layer-swelling inhibitor such as Glauber's salt. Also, if desired, an acid, an alkali, or a salt may be added to the fogging bath to provide a buffer capacity to the bath.

The concentration of the fogging agent in the fogging bath depends upon the halide composition of silver halide and the amount of silver in the silver halide emulsion layers of color photographic materials to be processed, but the proportion of the fogging agent is usually not less than about 10 mg per liter of the fogging bath. The concentration of the fogging agent, e.g., boron compound, is usually 10 to 1000 mg, preferably 20 to 300 mg per liter of the fogging bath.

With respect to the halide compositions, a color photographic material prepared using silver halides containing a comparatively large proportion of iodine generally gives sufficient results even if the concentration of the fogging agent of the fogging bath is high, but the too great an excess concentration of the fogging agent reduces the coloring density. With respect to the amount of silver, the concentration of the fogging agent of the fogging bath can be reduced as the proportion of silver is lower.

The fogging agents will, of course, be used at the optimum concentrations according to the characteristics of each color photographic material to be processed. For instance, when a standard silver iodide color photographic material, that is, a reversal color photographic material which contains 3.5 g (calculated as silver) of silver iodobromide containing 5 mol% silver iodide in the silver halide emulsion layers per square meter of the color photographic material is processed in a fogging bath containing borohydride, the optimum concentration of sodium borohydride is 60 mg/l.

The pH of the fogging bath can be selected over a wide range. When a fogging bath containing a boron compound is used, it is preferred that the bath be adjusted to an alkalinity of higher than pH 7 since a low pH fogging bath promotes decomposition of the fogging agent. It is particularly preferred that the pH of the fogging bath be higher than 9, most preferably about 11 to 13.

The reversal color photographic process of this invention can be practiced according to conventional reversal color processes employed in the art, except that an independent fogging is used, i.e., after image-wise exposure, the color photographic material is, if desired, subjected to a pretreatment such as a pre-hardening and aldehyde neutralization and then subjected to a first development (black and white development) to develop exposed portions. The color photographic material is then processed in the fogging bath to convert remaining silver halide to the developable state. Thereafter, the color photographic material is subjected to color development and then to a bleach and fix or to a blix to remove silver therefrom. If desired, various auxiliary baths such as an image stabilization bath, a hardening bath, a stop bath, a neutralization bath, washing, and rinsing can be added between such steps and after such steps.

For color development, an alkaline aqueous solution (having a pH of greater than 8, preferably 9 to 12) containing a primary aromatic amino color developing agent is used. As is well known, color developers may contain benzyl alcohol. The color developing agent is a compound which forms a colored product by the reaction of the oxidation product thereof with a color coupler. Examples of preferred color developing agents are p-phenylenediamines such as, for instance, 4-amino-N,N-diethylaniline, 4-amino-3-ethoxy-N,N-diethylaniline, 4-amino-3,5-dimethyl-N,N-diethylaniline, 4-amino-3-methyl-N-ethyl-N-(β-hydroxyethyl)aniline, 4-amino-3-methyl-N,N-diethylaniline, 4-amino-3-methyl-N-ethyl-N-(β-methylsulfonamidoethyl)aniline, 4-amino-3-(β-methylsulfonamidoethyl)-N,N-diethylaniline, 4-amino-N-ethyl-N-(β-hydroxyethyl)aniline, 4-amino-N,N-diethylaniline, and 4-amino-N-ethyl-N-ω-sulfobutylaniline. Mixtures of these amines or salts (e.g., hydrochlorides, sulfates, sulfites, etc.) thereof can be also used.

Moreover, the compounds described in U.S. Pat. Nos. 2,193,015 and 2,592,364 and Japanese Patent Application Laid Open No. 64933/1973 can be used as the color developing agent in this invention.

The black and white developer and the color developer used in this invention can further contain conventional additives such as salts such as sodium sulfate, etc.; a pH-controlling agent such as sodium hydroxide, sodium carbonate, sodium phosphate, etc.; a buffer such as acetic acid, carbonic acid, boric acid, and the salts of such acids; a development accelerator (for instance, the various pyridinium compounds as described in U.S. Pat. Nos. 2,648,604 and 3,671,247); cationic compounds; potassium nitrate; sodium nitrate; the polyethylene glycol and condensates and derivatives thereof as described in U.S. Pat. Nos. 2,533,990, 2,577,127 and 2,950,970; nonionic compounds such as the polythioethers as described in British Pat. Nos. 1,020,033 and 1,020,032; polymer compounds having a sulfate ester group as described in U.S. Pat. No. 3,068,097; organic amines such as pyridine, ethanolamine, etc.; and hydrazines).

The color developers may further contain an antifoggant (e.g., an alkali bromide; an alkali iodide; the nitrobenzimidazoles as described in U.S. Pat. Nos. 2,496,940 and 2,656,271; mercaptobenzimidazole; 5-methylbenztriazole; 1-phenyl-5-mercaptotetrazole; the compounds for quick processing as described in U.S. Pat. Nos. 3,113,864, 3,342,596, 3,295,976, 3,615,522, 3,295,976 and 3,597,199; the thiosulfonyl compounds as described in British Pat. No. 972,211; the phenazine-N-oxides as described in Japanese Patent Publication 41675/1971; and the antifoggants described in *Kagaku Shashin Binran* (*Handbook of Scientific Photography*), Vol. 2, pages 6–47); the stain or sludge prevention agents as described in U.S. Pat. Nos. 3,161,513 and 3,161,514 and British Pat. Nos. 1,030,442, 1,144,481 and 1,251,558; the multilayer effect accelerators as described in U.S. Pat. No. 3,536,487; and preservatives such as a sulfite, an acid sulfite, and a hydroxylamine hydrochloride.

In the process of this invention, the color photographic materials may be pre-treated in a conventional manner prior to the first development. As such a pretreatment, a prehardening is usually employed. A prehardening bath contains an aldehyde having the action of hardening by reaction with the gelatin in the photographic emulsion layers, such as the aliphatic aldehydes as described in U.S. Pat. No. 3,232,761 (e.g., formaldehyde, glyoxal, succinaldehyde, glutaraldehyde, pyruvic aldehyde, etc.) and the aromatic aldehydes as described in U.S. Pat. Nos. 3,565,632 and 3,677,760.

The pre-treatment bath may further contain conventional additives such as an inorganic salt such as sodium sulfate, etc.; a pH-controlling agent or a buffer such as borax, boric acid, acetic acid, sodium acetate, sodium hydroxide, sulfuric acid, etc.; and an antifoggant for development such as an alkali halide (e.g., potassium bromide).

In general, in the case of employing the pre-hardening bath, a neutralization bath is also employed to prevent the aldehydes used in the pre-hardening step from being carried into the subsequent development step. The neutralization bath contains an aldehyde removing agent such as hydroxylamine and L-ascorbic acid together with, if desired, an inorganic salt, a pH-controlling agent, and a buffer.

The additives illustrated above in regard to the processing steps as well as the amounts of these additives are well known in color photographic processes.

After the color development is completed, the color photographic material is usually bleached and fixed. The bleach step and the fix step may be performed in one bath called a blix bath. The bleaching, fixing and blixing baths of the present invention are conventional and there is no limitation on the identity of these baths.

As bleaching agents, there are many usable compounds but among them the following materials are generally used: the complex salts of organic acids and polyvalent cations such as ferricyanates, dichromates, water-soluble iron (III) salts, water-soluble cobalt (III) salts, water-soluble copper (II) salts, water-soluble quinones, nitrosophenol, iron (III), cobalt (III), and copper (II); aminopolycarboxylic acids such as ethylenediaminetetraacetic acid, nitrilotriacetic acid, iminodiacetic acid, N-hydroxyethyl ethylenediaminetriacetic acid, etc.; the metal complex salts of acids such as malonic acid, tartaric acid, malic acid, diglycolic acid, and dithioglycolic acid; 2,6-dipicolinic acid-copper complex salts; peracids or peracid salts such as alkyl peracids, persulfates, permanganates, and hydrogen peroxide; hypochlorites; chlorine; bromine; and bleaching powder. They may be used individually or as a combination thereof.

Any conventional fix solution can be used for the fix step in this invention, e.g., the fix solution ordinarily contains 50–200 g/l of ammonium thiosulfate, sodium thiosulfate, or potassium thiosulfate. The fix solution may further contain a stabilizer such as a sulfite and a metabisulfate; a hardening agent such as potassium alum, etc.; a pH-buffer such as an acetate and a borate. The pH of the fix solution is not limited and acid or basic fix solutions can be used.

Bleaching agents, fixing agents, and blix baths are described in detail in U.S. Pat. Nos. 3,227,552 and 3,582,322.

The image stabilization baths used in this invention may be prepared according to the processes described in U.S. Pat. Nos. 2,515,121, 2,518,686, and 3,140,177.

In the aforesaid process of this invention, each processing step can be carried out at a temperature below 20° C. or, if desired, at a temperature higher than 20° C. or higher than about 30° C. Most preferably processing is carried out at a temperature of about 32°–60° C. The temperatures of the steps need not be the same in each step but may be different.

The silver halide photographic emulsions used in this invention are conventional, and include those prepared by dispersing silver chloride, silver bromide, silver chlorobromide, silver iodobromide, silver chloroiodobromide, etc., in an aqueous solution of a natural or synthetic high molecular weight material such as gelatin, a gelatin derivative (e.g., gelatin phthalate, gelatin malonate, etc.), colloidal albumin, and cellulose derivative.

The silver halide emulsions may be chemically sensitized in a conventional manner. The chemical sensitizers used for this purpose are, for instance, the gold compounds such as the chloroaurates and gold trichloride as described in U.S. Pat. Nos. 2,399,083, 2,540,085, 2,597,856, and 2,540,085; the salts of platinum, palladium, iridium, rhodium, and ruthenium as described in U.S. Pat. Nos. 2,448,060, 2,540,086, 2,566,245, 2,566,263, and 2,598,079; the sulfur compounds capable of forming silver sulfide by reaction with silver salts as described in U.S. Pat. Nos. 1,574,944, 2,410,689, 3,189,458, and 3,501,313; the stannous salts and other reducing materials as described in U.S. Pat. Nos. 2,487,850, 2,518,698, 2,521,925, 2,521,926, 2,694,637, 2,893,610, and 3,201,254, etc.

Various compounds may be incorporated in the silver halide photographic emulsions for preventing a reduction in sensitivity and fogging during the manufacture, storage, or processing of the color photographic materials. Examples of these additives are 4-hydroxy-6-methyl-1,3,3a,7-tetraazaindene, 3-methylbenzothiazole, 1-phenyl-5-mercaptotetrazole, and other various heterocyclic compounds, mercury compounds, mercapto compounds, and metal salts well known in the art for such purposes.

Specific examples of these additives are described in C. E. K. Mees, *The Theory of the Photographic Process*, 3rd Ed., (1966) as well as U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, 3,622,339, and British Pat. Nos. 893,428, 403,789, 1,173,609, and 1,200,188.

The photographic emulsion layers may be hardened in a conventional manner. Examples of hardening agents used for this purpose are aldehyde compounds such as formaldehyde, glutaraldehyde, etc.; ketone compounds such as diacetyl, cyclopentanedione, etc.; bis(2-chloroethylurea); 2-hydroxy-4,6-dichloro-1,3,5-triazine; the reactive halogen-containing compounds as described in U.S. Pat. Nos. 3,288,775 and 2,732,303 and British Pat. Nos. 974,723 and 1,167,207; divinylsulfone; 5-acetyl-1,3-diacroylhexahydro-1,3,5-triazine; the reactive olefin-containing compounds as described in U.S. Pat. Nos. 3,635,718 and 3,232,763 and British Pat. No. 994,869; N-hydroxymethylphthalimide; the N-methylol compounds as described in U.S. Pat. Nos. 2,732,316 and 2,586,168; the isocyanates as described in U.S. Pat. No. 3,103,437; the aziridine compounds as described in U.S. Pat. Nos. 3,017,280 and 2,983,611; the acid derivatives as described in U.S. Pat. Nos. 2,725,924 and 2,725,295; the carbodiimide compounds as described in U.S. Pat. No. 3,100,704; the epoxy compounds as described in U.S. Pat. No. 3,321,313; the isooxazole compounds as described in U.S. Pat. Nos. 3,321,313 and 3,543,292; halogeno-carboxyaldehydes such as mucochloric acid, etc.; dioxane derivatives such as dihydroxydioxane, dichlorodioxane, etc.; and chromium alum and zirconium sulfate as inorganic hardening agents.

Furthermore, precursors thereof, such as the addition product of an alkali metal bisulfite and an aldehyde, a methylol derivative of hydantoin, and a primary aliphatic nitro alcohol can be used.

The silver halide photographic emulsions used in this invention can be, if desired, subjected to spectral sensitization or to super-sensitization using a cyanine dye such as cyanine, merocyanine, carbocyanine, etc., individually or as combinations thereof or further as a combination of such dyes and a styryl dye, etc. Such dye sensitization techniques are well known as described in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588, 1,293,302, 1,242,588, and 1,293,862, German Pats. (OLS) 2,030,326 and 2,121,780, Japanese Pat. Publications 4936/1968, 14030/1969, and 10773/1968, U.S. Pat. Nos. 3,511,664, 3,522,052, 3,527,641, 3,615,613, 3,615,632, 3,617,295, 3,635,721, and 3,694,217, and British Pat. Nos. 1,137,580 and 1,216,203. The dyes may be selected according to the end use of the photographic materials and the wavelength regions and sensitivities desired.

The reversal color photographic materials used in this invention can contain in the silver halide emulsion layers thereof magenta couplers, cyan couplers, and yellow couplers as are well known in the art. That is, 5-pyrazolone compounds, indazolone compounds and cyanoacetyl compounds having an active methylene group can be used as the magenta coupler. Examples of the magenta couplers used in this invention are described in U.S. Pat. Nos. 2,600,788, 2,983,608, 3,006,759, 3,062,653, 3,214,437, 3,253,924, 3,311,476, 3,337,344, 3,419,391, 3,419,808, 3,476,560, and 3,582,322, British Pat. No. 1,142,553, Japanese patent publication No. 20636/1970, and Japanese patent application Laid Open 26133/1972. Preferred magenta couplers used in this invention are the compounds represented by general formula (III):

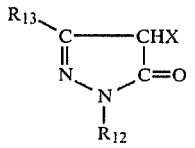

(III)

wherein $R_{12}$ represents a substituted or unsubstituted alkyl group, a substituted or unsubstituted aryl group, or a substituted or unsubstituted heterocyclic group; $R_{13}$ represents an alkyl group, a carbamyl group, an amino group, or an amido group; and X represents a coupling non-releasable group (e.g., a hydrogen atom) or a coupling releasable group (e.g., a thiocyano group, an acyloxy group, an aryloxy group, an alkoxy group, and a halogen atom).

Specific examples of preferred magenta couplers are as follows:

1-p-sec-amylphenyl-3-n-amyl-5-pyrazolone,
2-cyanoacetyl-5-(p-sec-amylbenzoylamino)cumarone,
2-cyanoacetylcumarone-5-(N-n-amyl-p-t-amylsulfoanilide),
2-cyanoacetylcumarone-5-sulfone-N-n-butylanilide,
1-p-laurylphenyl-3-methyl-5-pyrazolone,
1-β-naphthyl-3-amyl-5-pyrazolone,
1-p-nitrophenyl-3-n-amyl-5-pyrazolone,
1-phenyl-3-acetylamino-5-pyrazolone,
1-phenyl-3-n-valerylamino-5-pyrazolone,
1-phenyl-3-chloroacetylamino-5-pyrazolone,
1-phenyl-3-(m-aminobenzoyl)amino-5-pyrazolone,
1-p-phenoxyphenyl-3-(p-t-amyloxybenzoyl)amino-5-pyrazolone,
1-(2',4',6'-trichlorophenyl)-3-benzamido-5-pyrazolone,
1-(2',4'-dichlorophenyl)-3-[3''-(2''',4'''-di-t-amylphenoxyacetamido)benzamido]-5-pyrazolone,
1-(2',4'-dimethyl-6'-chlorophenyl)-3-[3''-(2''',4'''-di-t-amylphenoxyacetamido)benzamido]-5-pyrazolone,
1-(2',4',6'-trichlorophenyl)-3-(4''-nitroanilino)-4-stearoyloxy-5-pyrazolone,
1-(2',4',6'-trichlorophenyl)-3-{3''-[α-(2'',4''-di-t-amylphenoxy)acetamido]benzamido}-4-acetoxy-5-pyrazolone,
1-(2',4',6'-trichlorophenyl)-3-pentadecyl-4-thiocyano-5-pyrazolone
1-(2',4',6'-trichlorophenyl)-3-[3''-(2''',4'''-di-t-amylphenoxyacetamido)benzamido]-4-thiocyano-5-pyrazolone,
1-(2',4',6'-trichlorophenyl)-3-pentadecyl-4-sulfo-5-pyrazolone,
1-(2',4',6'-trichlorophenyl)-3-pentadecyl-4-chloro-5-pyrazolone.

Phenolic compounds or naphtholic compounds are used as the cyan couplers in this invention. The cyan couplers used in this invention are described in U.S. Pat. Nos. 2,474,293, 2,698,794, 3,034,892, 3,214,437, 3,253,924, 3,311,476, 3,458,315, 3,582,322, and 3,591,383, and Japanese patent publications Nos. 11304/1967 and 32461/1969.

The preferred phenolic cyan couplers and naphtholic cyan couplers used in this invention are represented by general formulae (IV) and (V), respectively:

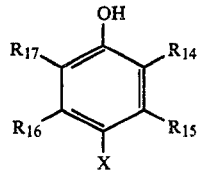

(IV)

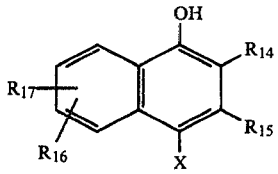

(IV)

wherein $R_{14}$, $R_{15}$, $R_{16}$, and $R_{17}$ each represents a hydrogen atom, an alkyl group, an aryl group, a heterocyclic group, an amino group (e.g., an amino group, alkylamino group, arylamino group, heterocyclic amino group, etc.), a carbonamido group (e.g., an alkylcarbonamido group, arylcarbonamido group, heterocyclic carbonamido group, etc.), a sulfonamido group (e.g., an alkylsulfonamido group, arylsulfonamido group, heterocyclic sulfonamido group, etc.), a sulfamoyl group (e.g., an alkylsulfamoyl group, arylsulfamoyl group, heterocyclic sulfamoyl group, etc.), a carbamoyl group (e.g., alkylcarbamoyl group, arylcarbamoyl group, heterocyclic carbamoyl group, etc.), a cyano group, a halogen atom (e.g., chlorine atom, etc.), an alkoxy group, or an aryloxy group; where $R_{14}$, $R_{15}$, $R_{16}$, and $R_{17}$ can advantageously be substituted with a ballast group as earlier exemplified; and X represents a coupling non-releasable group such as a hydrogen atom or a coupling releasable group such as a chlorine atom, a bromine atom, an iodine atom, a thiocyano group, an acyloxy group (e.g., alkoyloxy group, aroyloxy group, heterocycloyloxy group, etc.), and a cyclic imido group (e.g., maleimido group, succinimido group, 1,2-dicarboxyimido group, 2-dicarboxyimido group, phthalimido group, etc.).

In the heretofore offered discussion regarding compounds of general formulae (I) to (III), any alkyl moiety preferably has 1 to 20 carbon atoms, unless otherwise indicated, and preferred aryl groups include the following examples:

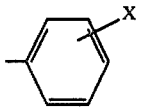

(X: Cl, CONH)

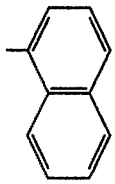

-continued

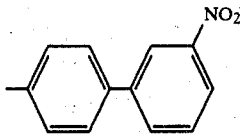

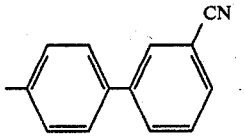

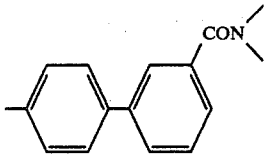

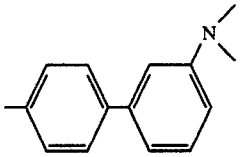

It is thus seen that the aryl groups include both mono- and poly-aryl groups.

Specific examples of cyan couplers used in this invention are as follows:

5-(p-amylphenoxybenzenesulfoamino)-1-naphthol,
5-(N-benzyl-N-naphthalenesulfoamino)-1-naphthol,
5-(N-benzyl-N-n-valerylamino)-1-naphthol,
5-caproylamino-1-naphthol,
2-chloro-5-(p-nitrobenzoyl-β-o-hydroxyethylamino)-1-naphthol,
2-chloro-5-palmitylamino-1-naphthol,
2,2'-dihydroxy-5,5'-dibromostilbene,
5-diphenyl ether sulfoamido-1-naphthol,
1-hydroxy-2-(N-sec-amylphenyl)naphthamide,
5-phenoxyacetamido-1-naphthol,
monochloro-5-(N-γ-phenylpropyl-N-p-sec-amylbenzoylamino)-1-naphthol,
2-acetylamino-5-methylphenol,
2-benzoylamino-3,5-dimethylphenol,
1-hydroxy-2-[N-α-(2,4-di-t-amylphenoxy)-n-butyl]-naphthamide
2-(4''-t-amyl-3'-phenoxybenzoylamino)phenol.

Open chain diketomethylene compounds are generally used as yellow couplers. Examples of the yellow couplers used in this invention are described in U.S. Pat. Nos. 3,341,331, 2,778,658, 2,908,573, 3,227,550, 3,253,924, 3,384,657, 2,875,057, and 3,551,155, German Patent (OLS) 1,547,868, U.S. Pat. Nos. 3,285,506, 3,582,322, and 3,725,072, German Pat. (OLS) No. 2,162,899, U.S. Pat. Nos. 3,369,895, 3,408,194, 3,227,155, 3,447,928, and 3,415,652, and German Pat. (OLS) Nos. 2,057,941, 2,213,461, 2,219,917, 2,261,361, and 2,263,875.

Preferred yellow couplers used in this invention are the compounds represented by general formula (VI):

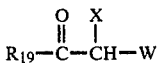

(VI)

wherein $R_{19}$ represents an unsubstituted or substituted alkyl group, an unsubstituted or substituted aromatic group, or an unsubstituted or substituted heterocyclic group; X represents a coupling non-releasable group such as a hydrogen atom or a coupling releasable group; and W represents a cyano group or a carbamoyl group.

Specific examples of preferred yellow couplers used in this invention are as follows:

α-{3-[α-(2,4-di-t-amylphenoxy)butyramido]benzoyl}-2-methoxyacetanilide,
α-{3-[α-(2,4-di-t-amylphenoxy)acetamido]benzoyl}-2-chloroacetanilide,
2-chloro-3'-[4-(2,4-di-t-amylphenoxy)butyramido]-benzoylacetanilide,
α-{3-[α-(2,4-di-t-amylphenoxy)acetamido]benzoyl}-benzoylacetanilide,
α-pivaloyl-2,5-dichloro-4-[N'-(n-octadecyl)-N'-methylsulfamyl]acetanilide,
2-(4''-t-amyl-3'-phenoxybenzoyl)phenol,
α-pivaloyl-2-chloro-5-[α-(2',4'-di-tert-amylphenoxy)-butyramido]acetanilide,
α-{3-[α-m-pentadecylphenoxy)butyramido]benzoyl}-2-chloroacetanilide,
α-(2',4'-dimethoxybenzoyl)-2-chloro-5-(2'-hexyldecyloxycarbonyl)acetanilide,
α-pivaloyl-α-[4-(4-benzoyloxyphenylsulfonyl)-phenoxy]-2-chloro-5-[γ-(2,4-di-t-amylphenoxy)-butyramido]acetanilide,
α-o-methoxybenzoyl-α-chloro-4-[α-(2,4-di-t-amylphenoxy)-n-butylamido]acetanilide,
α-fluoro-α-pivaloyl-5-[γ-(2,4-di-t-amylphenoxy)-butyramido]-2-chloroacetanilide,
α-acetoxy-α-{3-[γ-(2,4-di-t-amylphenoxy)-butyramido]-benzoyl}-2-methoxyacetanilide,
α-pivaloyl-α-stearoyloxy-4-sulfamylacetanilide,
α-{3-[α-(m-pentadecylphenoxy)butyramido]benzoyl}-2-chloroacetanilide,
α-{3-[α-(2,3-di-t-amylphenoxy)butyramido]benzoyl}-2-methoxyacetanilide,
α-benzoyl-α-thiocianoacetanilide,

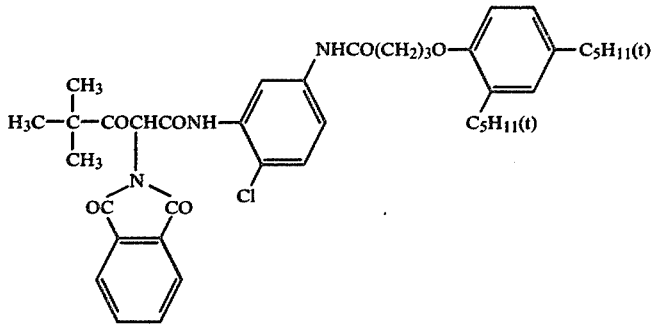

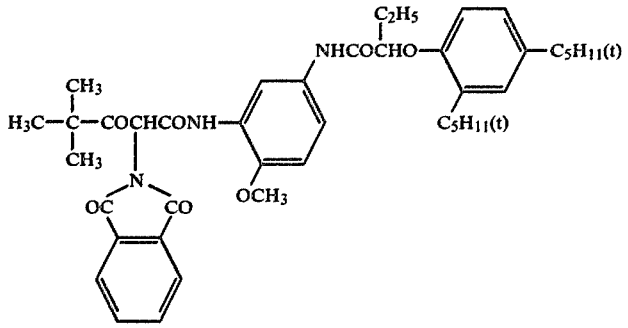

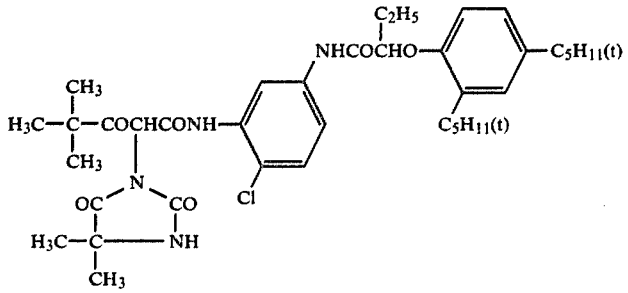

-continued
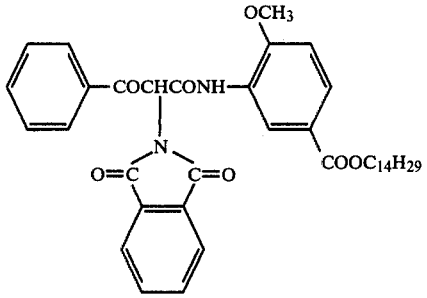
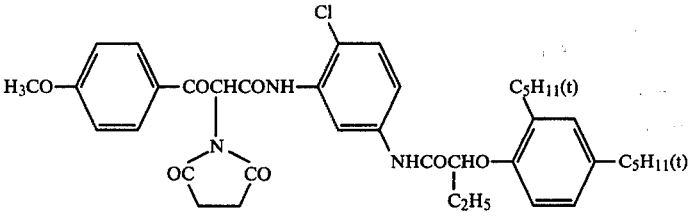
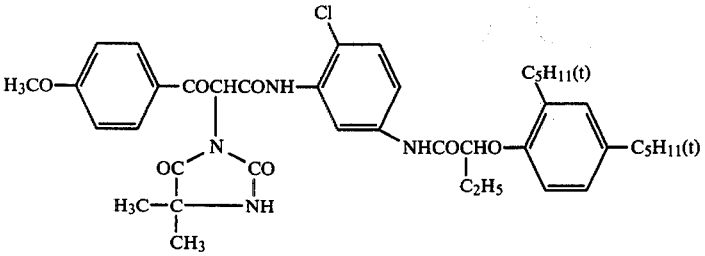
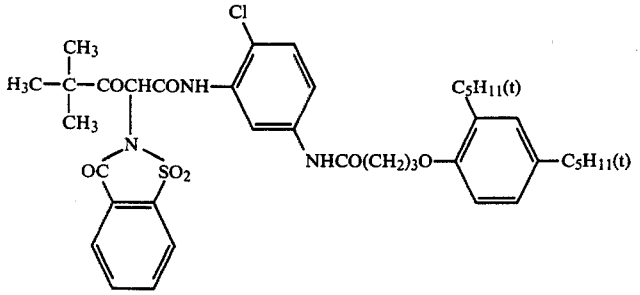
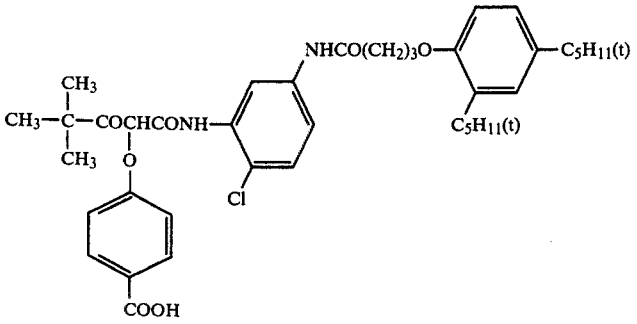

-continued
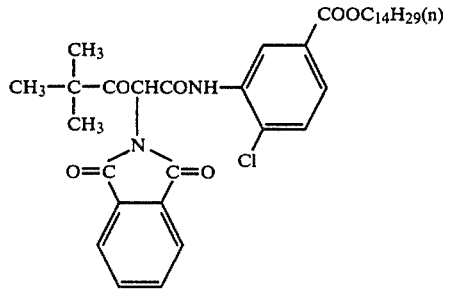
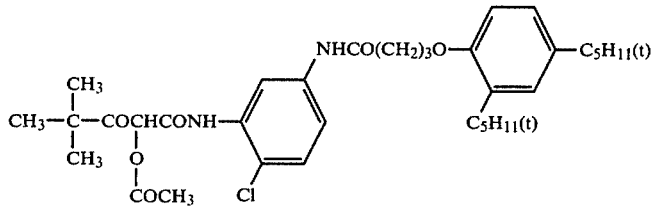
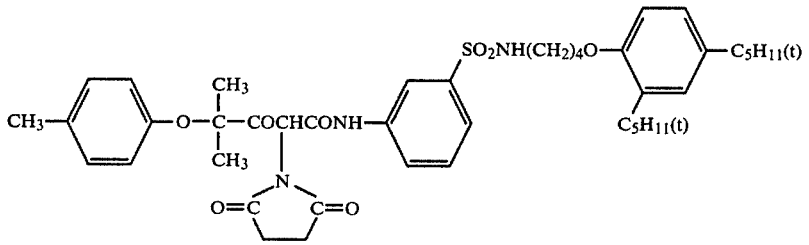
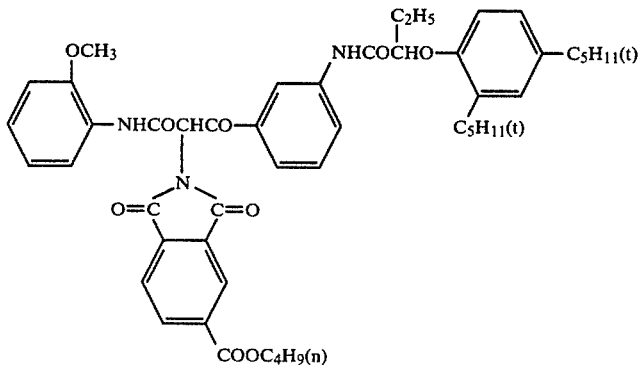
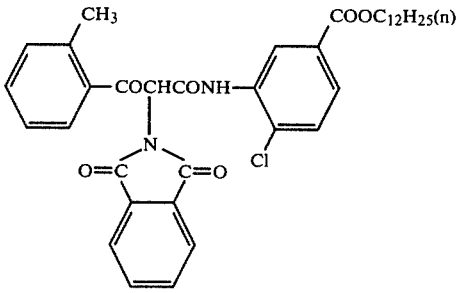

-continued
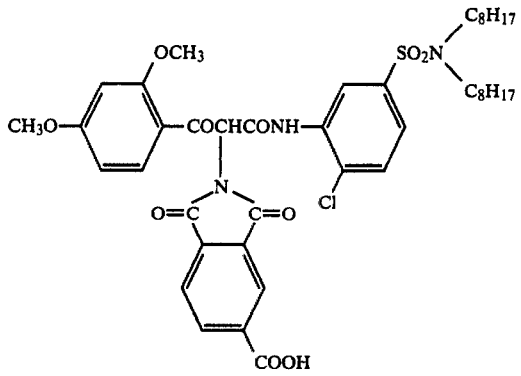
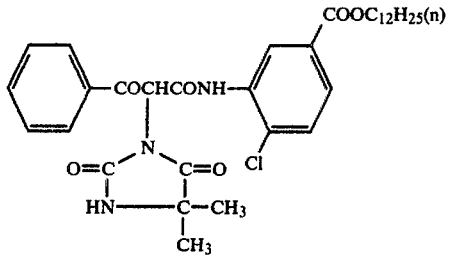
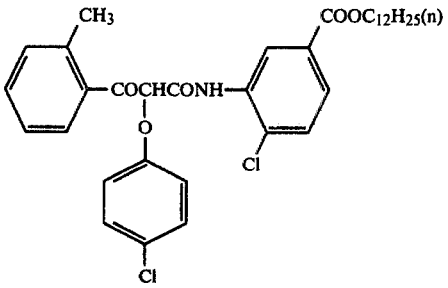
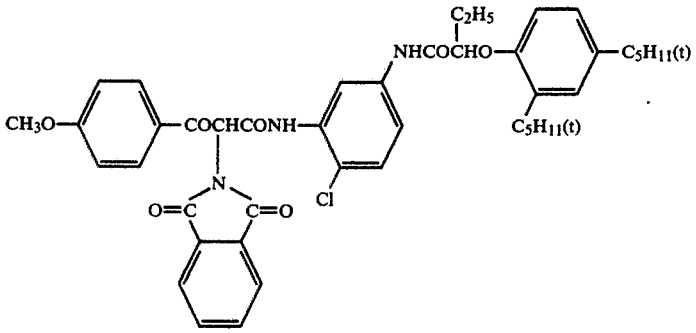
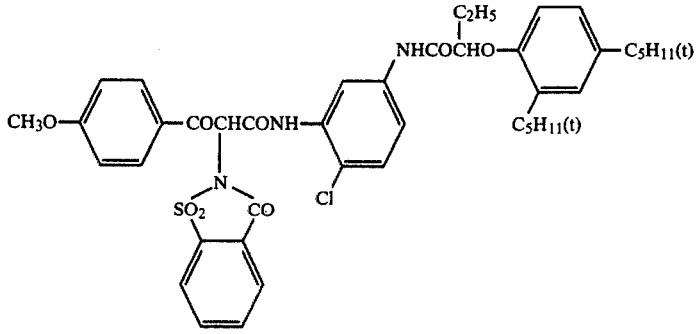

-continued
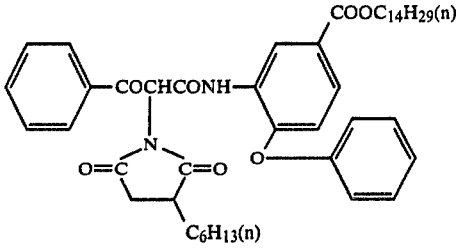
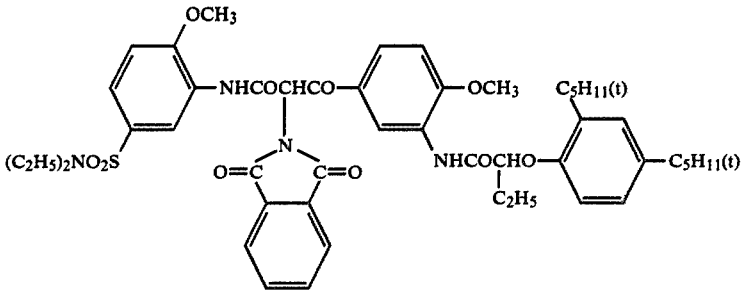
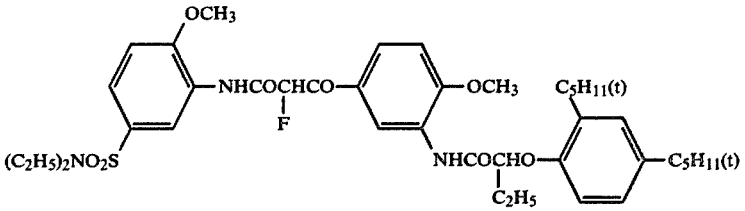
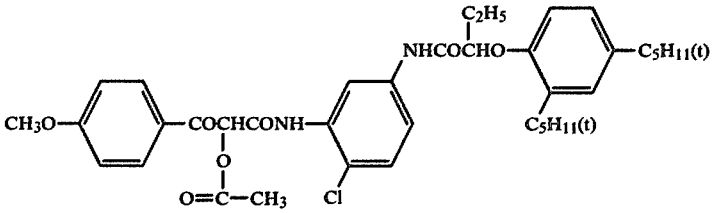
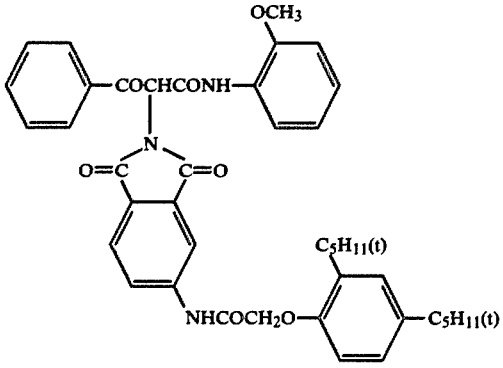
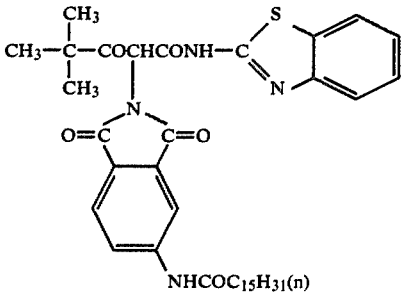

-continued
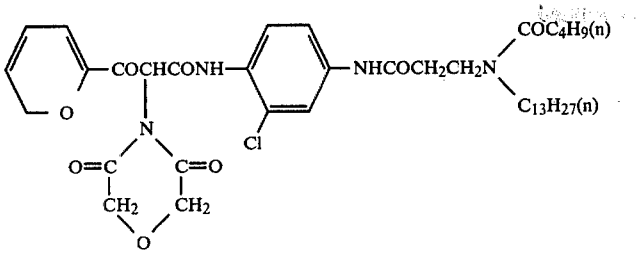
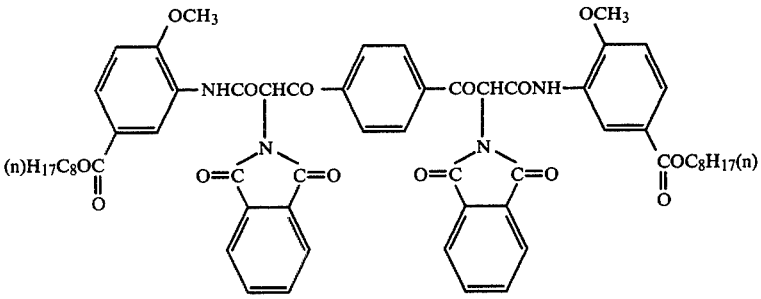
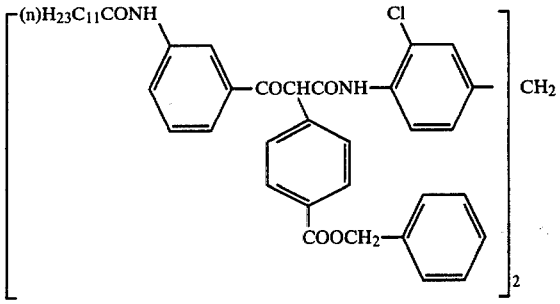
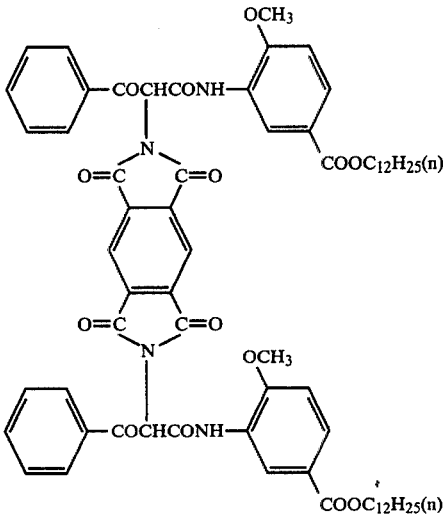
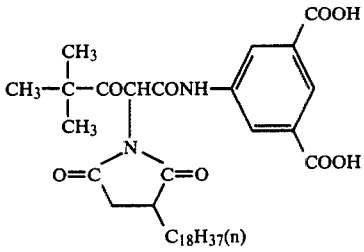

-continued
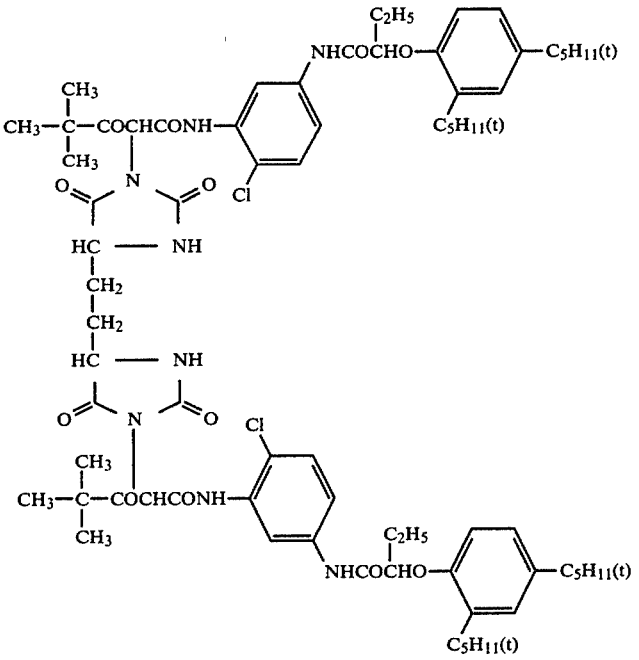
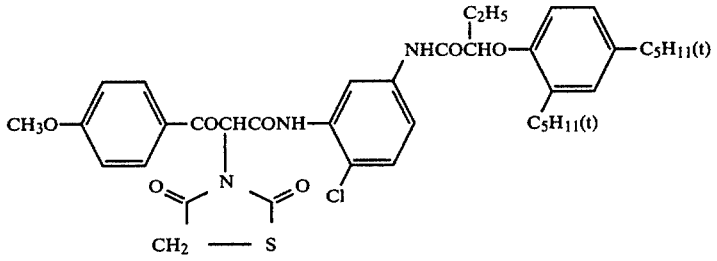
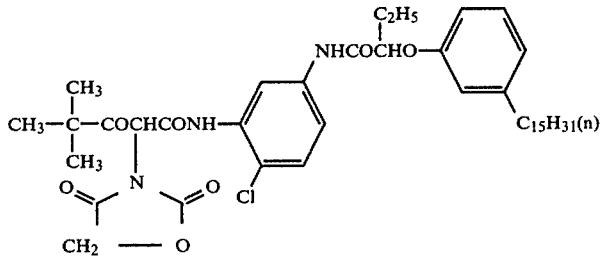
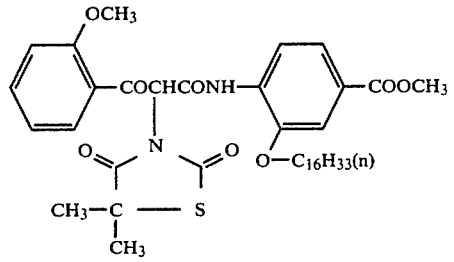

-continued
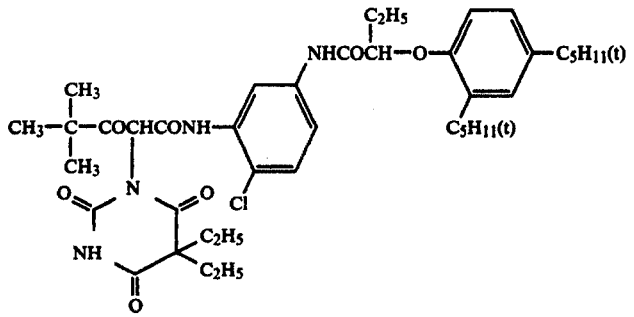
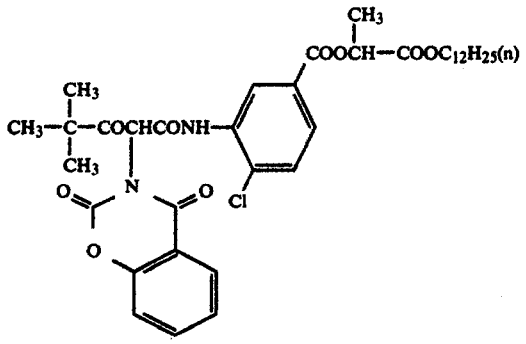
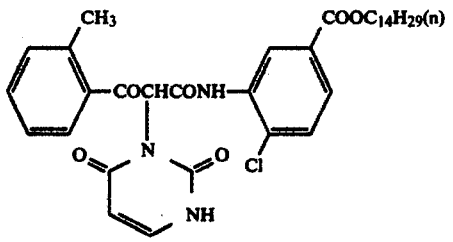
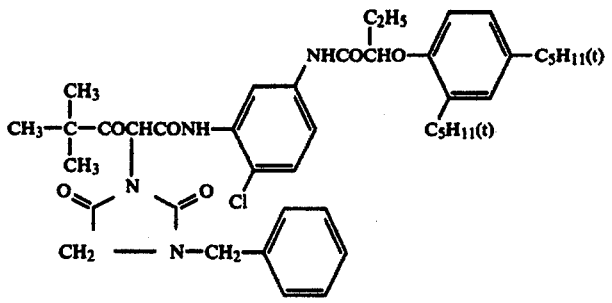
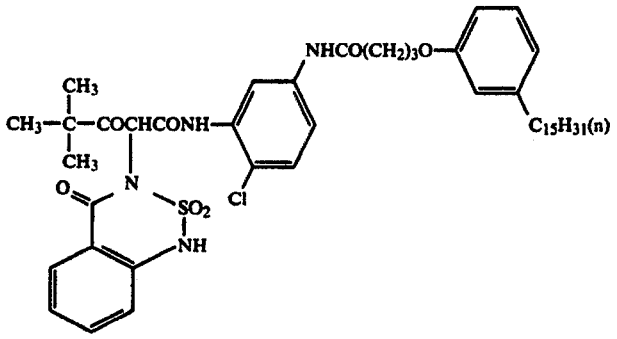

-continued
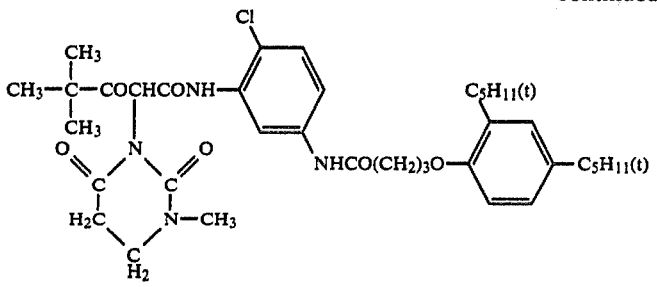
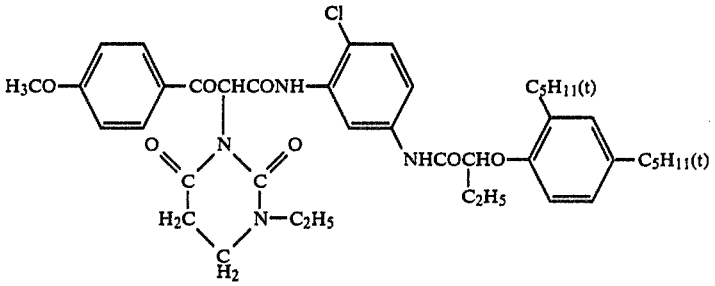
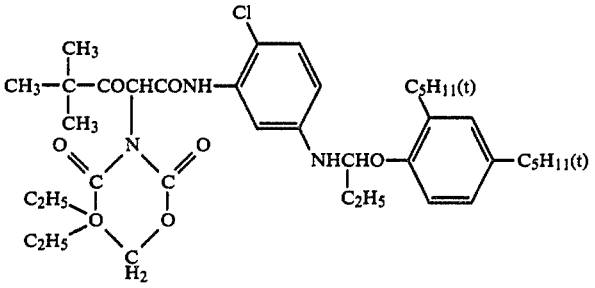
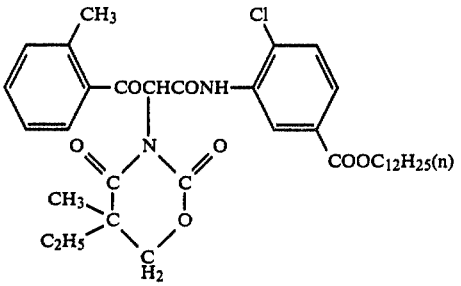
Other examples of yellow couplers used in this invention are as follows, in which X represents a coupling-off or coupling releasable group.
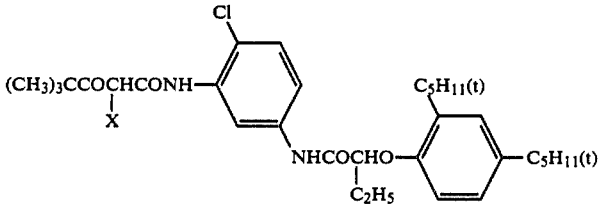

-continued
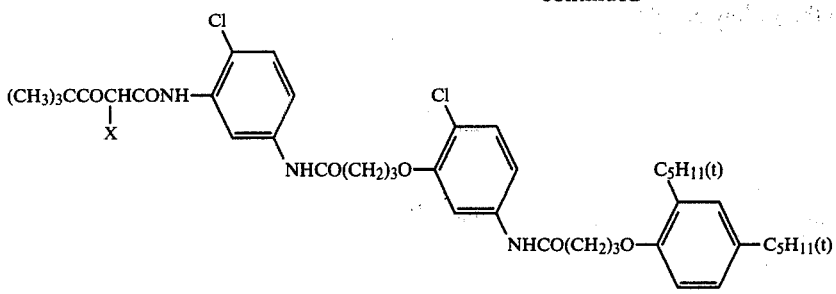
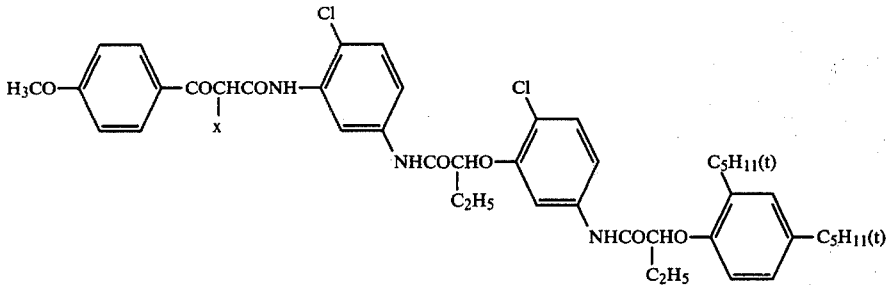
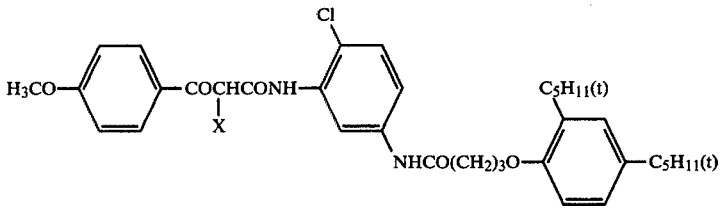
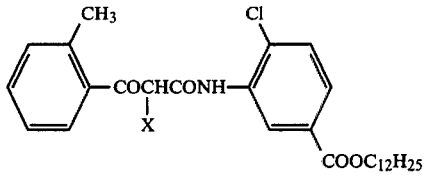
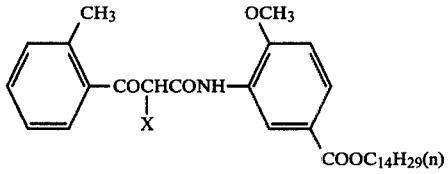
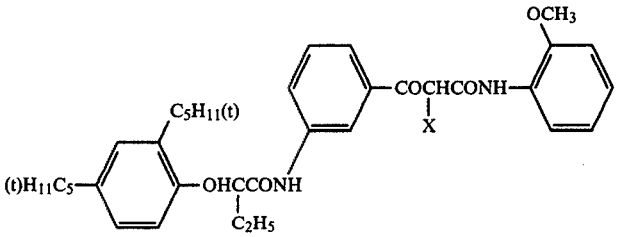
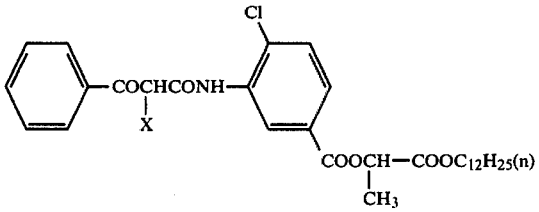

Moreover, the following coupling-off or coupling releasable groups are also useful in the yellow couplers used in this invention.
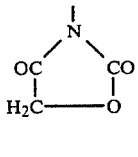
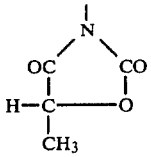
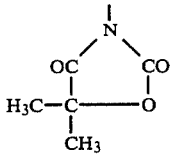
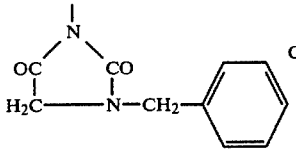
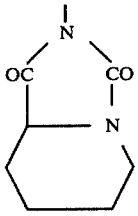
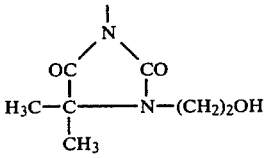
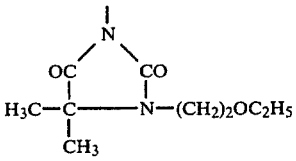
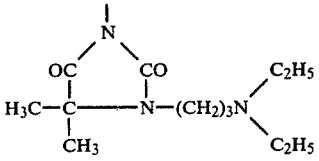
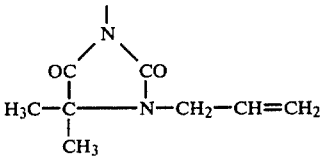
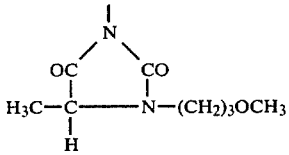
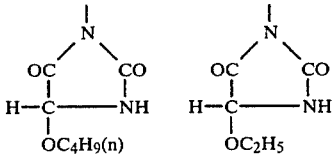
-continued
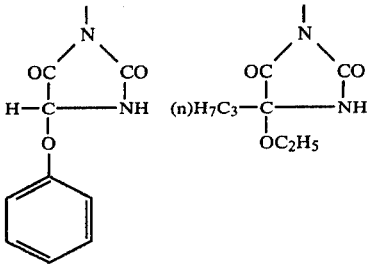
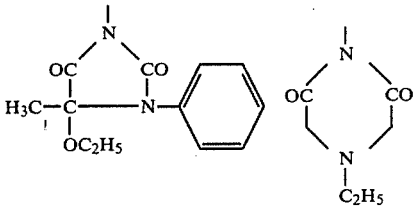
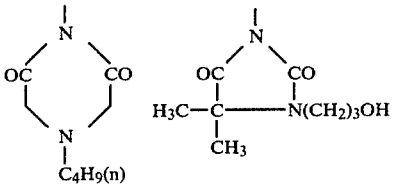
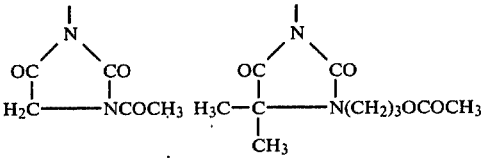
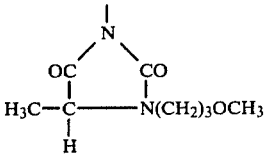
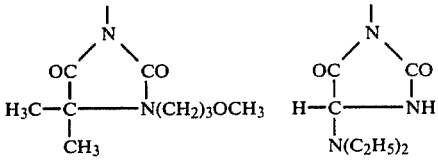
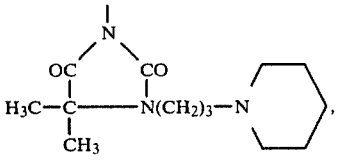
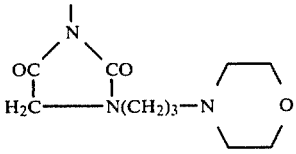

The couplers illustrated above can be prepared by the methods described in U.S. Pat. Nos. 3,277,155, 3,408,194, and 3,447,028, German Offenlegungsschrift 2,057,941, U.S. Pat. Nos. 2,350,138, 2,359,332, 2,407,210, 2,875,057, 3,265,506, 3,341,331, 3,409,439, 3,551,155, 3,551,156, 3,649,279, and British Pat. Nos. 1,261,156 and 1,296,411. Also, the couplers may dispersed by the method described in U.S. Pat. No. 2,801,171.

Surface active agents may be added to the silver halide photographic emulsions used in this invention, individually or as a mixture thereof. They are usually used as coating aids but they are sometimes used for other purposes such as emulsification dispersing, sensitization, improvement of photographic properties, static prevention, and adhesion prevention.

Examples of such surface active agents are nonionic surface active agents such as alkylene oxide surface active agents, glycerol surface active agents, and glycidol surface active agents; cationic surface active agents such as higher alkylamines, quaternary ammonium salts, pyridine and other heterocyclic compounds, phosphoniums, and sulfoniums; anionic surface active agents having a carboxylic acid, sulfonic acid, phosphoric acid, a phosphoric acid ester group, or a sulfuric acid ester group; and amphoteric surface active agents such as amino acids, aminosulfonic acids, and sulfuric acid esters or phosphoric acid esters of amino alcohols.

Many of these surface active agents are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, and 3,545,974, German Offenlegungsschrift 1,942,665, British Patents 1,077,317 and 1,198,450, Ryohei Oda et al; "Synthesis of Surface Active Agents and Applications thereof," published in 1964 by Maki Shoten; A. W. Perry; "Surface Active Agents;" Interscience Publication Incorporated, 1958; and J. P. Sisley and P. J. Wood; "Encyclopedia of Surface Active Agents;" Vol. 2; Chemical Publishing Co., 1964.

The photographic emulsion layers of the photographic materials can be formed on a support by various conventional coating methods including dip coating, air knife coating, curtain coating, and extrusion coating using a hopper as described in U.S. Pat. No. 2,681,394. If desired, two or more emulsion layers can be coated simultaneously by the methods described in U.S. Pat. Nos. 2,761,791, 3,508,947, 2,941,898, and 3,526,528.

The photographic emulsions are coated on any conventional support which does not cause undergo substantial dimensional changes during processing, such as a glass sheet, a metallic plate, an earthenware sheet or a flexible support. Typical examples of flexible supports are cellulose nitrate films, cellulose acetate films, cellulose acetate butyrate films, cellulose acetate propionate films, polyethylene terephthalate films, polystyrene films, polycarbonate films, laminates of these films, thin glass films, and papers. Furthermore, baryta-coated papers; papers coated with an α-olefin polymers, in particular a polymer of α-olefin having 2–10 carbon atoms, such as polyethylene, polypropylene and an ethylene-butene copolymer; and plastic films having a matted surface to improve their adhesive property to other polymers and printability, as described in Japanese patent publication No. 19068/1972, can be used with good results.

Transparent supports or opaque supports can be used according to the end use of the color photographic materials. Furthermore, as transparent supports, colorless supports as well as supports colored by dyes or pigments can be used. Colored transparent supports are conventionally used for X-ray photographic films and are described in "Journal of S. M. P. T. E.;" 67, 296 (1958).

Opaque supports can be originally opaque supports such as paper or can be opaque films prepared by incorporating dyes or pigments such as titanium oxide in transparent films or by treating the surfaces of a transparent film by the method as described in Japanese patent publication No. 19068/1972, as well as papers or plastic films which are provided with complete shading capability by the addition of carbon black or dyes. If the adhesion between the support and the photographic emulsion layer is insufficient, a layer having high adhesion to both elements may be formed on the support as a subbing layer. Also, to improve the adhesion of the support, the surface of the support can be subjected to a pre-treatment such as a corona discharge, ultraviolet irradiation or flame treatment.

The process of this invention can be applied to various silver halide reversal color photographic materials such as reversal color photographic papers, reversal color photographic films, reversal color photographic films for slides, reversal cinne color photographic films, and reversal color photographic films for television use.

One of the features of the process of this invention lies in the point of employing a fogging bath separately from color development baths without incorporating a fogging agent in the color development bath and the first development (black and white development) is carried out in the presence of on or more DIR compounds, whereby the harmful influence of the DIR compound at reversal color development as described before is avoided.

The advantages obtained by the process of this invention are as follows:

(1) Sufficient color density is obtained even if a DIR compound is used. When the first development in a reversal color process is carried out in the presence of the DIR compound, the undeveloped silver halide grains are affected by the development inhibitor to render the progress of the color development difficult, which results in a reduction in coloring density. On the other hand, in the process of this invention, the DIR compound exhibits its effect and sufficient color density is obtained.

(2) Color photographic images having sufficient sharpness are obtained. While the DIR compound improves the sharpness of color images in negative color development, in reversal development the silver halide grains are greatly affected by the development inhibitor (due the presence of the DIR compound in the first developer) and are subjected to color development and in such state that the sharpness of the color images formed usually becomes lower. On the other hand, by employing a fogging bath according to the present invention, such defect is overcome and color images having sufficient sharpness are obtained.

(3) Color photographic images having sufficient granularity are obtained. That is, by employing the fogging bath in this invention, the granularity of the color images formed is improved as in the aforesaid case.

(4) The stability of the color developer is improved. That is, a color developer for reversal color processing is originally unstable, which is a defect in the quality control of color developer manufacture. On the other hand, by employing the fogging bath, the stability or the life of the color developer can be improved, which is a secondary effect of this invention. The process of this invention thus has the advantage that the life of the color developer can be prolonged and the color development can be conducted in a stable manner. On the other hand, in a conventional color reversal system wherein the fogging agent is incorporated in the color developer, the color developer is quickly deteriorated and thus it is difficult to keep the stable quality of the color developer.

The invention will now be illustrated by several examples which are not to be construed as limitative.

EXAMPLE 1

Color photographic materials A and B were prepared in the following manner.

A color photographic material (Sample A) was prepared by coating on a cellulose triacetate film base an emulsified mixture of a red-sensitive silver iodobromide emulsion (containing 7 mole% silver iodide) and a cyan coupler, 1-hydroxy-4-chloro-2-n-dodecylnaphthamide, an emulsified mixture of a green-sensitive silver iodobromide emulsion (containing 6 mole% silver iodide) and a magenta coupler, 1-(2'-4',6'-trichlorophenyl)-3-[3''-(2'''4'''-di-t-amylphenoxyacetamido)benzamido]-5-pyrazolone, and an emulsified mixture of a blue-sensitive silver iodobromide emulsion (containing 6 mole% silver iodide) and a yellow coupler, α-pivaloyl-2-chloro-5-[γ-(2,4-di-t-amylphenoxy)butyramido]-acetanilide.

Another color photographic material (Sample B) was prepared in the same manner as in the case of preparing Sample A except that 2,5-dimethyl-3-(1-phenyl-5-tetrazolylthio)hydroquinone was incorporated in the emulsified mixture of the green-sensitive silver iodobromide emulsion as the DIR compound.

In addition, in preparing the above color photographic materials, each coupler was emulsified using dibutyl phthalate or tricresyl phosphate as a coupler solvent and sodium dodecylbenzenesulfonate and sorbitan monolaurate as emulsifying agents. Sodium 1-(p-nonylphenoxytrioxyethylene)butane-4-sulfonate and the lauric acid ester of sucrose were used as coating aids for the photographic emulsions.

In the above photographic material and in the following Examples, the following formulations were used:

the AgX/gelatin ratio (weight) was 2.0;

the Coupler/gelatin ratio (weight) was blue-sensitive layer 1.6; green-sensitive layer 0.5; red-sensitive layer 1.25;

the thickness of each emulsion layers was 5μ the solvent for the cyan and magenta couplers was dibutylphthalate and the solvent for the yellow coupler was tricresylphosphate;

the coupler/solvent ratio was: blue-sensitive layer 200 g/cc; green-sensitive layer 80 g/cc; red-sensitive layer 180 g/cc.

The thickness of each subsidiary layer, e.g., filter layer, protective layer, intermediate layer, was about 1μ.

Each of samples A and B prepared had a filter layer of yellow colloidal silver between the green-sensitive silver halide emulsion layer and the blue-sensitive silver halide emulsion layer, an interlayer consisting of gelatin having dispersed therein di-t-amylhydroquinone (to prevent diffusion of the oxidized developing agent from one layer to another layer, whereby color fog or color stain is reduced) between the green-sensitive silver halide emulsion layer and the red-sensitive silver halide emulsion layer, and a protective layer mainly consisting of gelatin on the blue-sensitive silver halide emulsion layer.

Furthermore, in each of the samples, the coverage of the red-sensitive silver halide emulsion layer was 1.5 g. $Ag/m^2$, that of the green-sensitive silver halide emulsion layer 1.5 g. $Ag/m^2$, and that of the blue-sensitive silver halide emulsion layer 1.5 g. $Ag/m^2$. The silver/coupler ratio in each layer was 8.0 in the red-sensitive silver halide emulsion layer, 9.5 in the green-sensitive silver halide emulsion layer and 8.0 in the blue-sensitive silver halide emulsion layer (all molar ratios).

Sample A is a conventional reversal color photographic material while Sample B is a reversal color photographic material in accordance with this invention.

The following runs were then carried out using each of the samples thus prepared.

Each of the color photographic films thus prepared was exposed (Source: tungsten; Color temp.: 3,200° K.; Exposure time: 1/100 sec.; same in following Examples unless otherwise indicated) and then subjected to the following processing I, II or III.

| Steps for processing I | | |
|---|---|---|
| 1st (black and white) development | 30° C. | 5 minutes |
| Stop | " | 1 minute |
| Wash | " | 2 minutes |
| Color development | " | 7 minutes |
| Stop | " | 2 minutes |
| Hardening | " | 2 minutes |
| Wash | " | 2 minutes |
| Bleach | " | 4 minutes |
| Wash | " | 2 minutes |
| Fix | " | 4 minutes |
| Wash | " | 2 minutes |
| Drying | " | 2 minutes. |

The compositions of the processing solutions used in the above processing were as follows:

| | |
|---|---|
| Black and white developer | |
| Sodium sulfite | 60.0 g |
| 1-Phenyl-3-pyrazolidone | 0.3 g |
| Hydroquinone | 5.0 g |
| Sodium carbonate (monohydrate) | 41.0 g |
| Potassium bromide | 2.0 g |
| Potassium iodide (1% aqueous soln) | 1.0 ml |
| Potassium thiocyanate (1 N aqueous soln.) | 10.0 ml |
| Sodium hydroxide (10% aqueous soln.) | 2.0 ml |
| Water to make | 1.0 liter |
| Step solution | |
| Sodium acetate | 30 g |
| Glacial acetic acid | 8 ml |
| Water to make | 1 liter |
| Color developer | |
| Benzyl alcohol | 5.0 ml |
| Sodium hydroxide | 0.5 g |
| Diethylene glycol | 3.0 ml |
| Sodium hexametaphosphate | 2.0 g |
| Sodium sulfite | 2.0 g |
| Potassium bromide | 2.0 g |
| 4-Amino-3-methyl-N-ethyl-β-hydroxyethylaniline sesquisulfate monohydrate | 5.0 g |

-continued

| | |
|---|---|
| Citrazinic acid | 0.4 g |
| Metaboric acid | 0.5 g |
| Ethylenediamine (70% aqueous soln) | 0.4 ml |
| Nabox | 77.0 g |
| Water to make | 1.0 liter |
| Hardening bath | |
| Sodium hexametaphosphate | 1.0 g |
| Borax. pentahydrate | 20.0 g |
| Formalin (37%) | 10.0 ml |
| Bleach solution | |
| Sodium ferric ethylenediamine tetraacetic acid dihydrate | 30.0 g |
| Potassium bromide | 50.0 g |
| Di-Sodium ethylenediamine tetra-acetate | 5.0 g |
| Boric acid | 3.0 g |
| Water to make | 1.0 liter |
| Fix solution | |
| Sodium thiosulfate | 150 g |
| Sodium sulfite | 15 g |
| Borax | 12 g |
| Glacial acetic acid | 15 ml |
| Potassium alum | 20 g |
| Water to make | 1 liter |

Processing II

Same as in processing I except that 0.1 g/liter of sodium borohydride was added to the color developer.

Processing III

Same as processing I except that after the 1st wash step was finished, the photographic material was processed in a fogging bath at 30° C. for 2 minutes and then subjected to the color development. The composition of the fogging bath used was as follows:

| | |
|---|---|
| Sodium hydroxide | 2.0 g |
| Sodium borohydride | 0.1 g |
| Water to make | 1.0 liter |

The photographic properties of the color images thus obtained are shown in the following table.

| Run No. | Photo-graphic material | Proces-sing | Dm R | Dm G | Dm B | Sharpness (CTF) 20 l/mm | Sharpness (CTF) 30 l/mm | Granular-ity (Distance (cm) | Note |
|---|---|---|---|---|---|---|---|---|---|
| 1 | A | I | 2.9 | 2.9 | 3.0 | 40 | 20 | 150 | Comparison Example |
| 2 | A | II | 3.1 | 3.1 | 3.2 | 45 | 25 | 150 | Comparison Example |
| 3 | A | III | 3.1 | 3.1 | 3.2 | 45 | 25 | 150 | Comparison Example |
| 4 | B | I | 2.0 | 1.9 | 1.8 | 25 | 10 | 220 | Comparison Example |
| 5 | B | II | 2.6 | 2.8 | 2.8 | 35 | 20 | 180 | Comparison Example |
| 6 | B | III | 3.1 | 3.1 | 3.2 | 50 | 30 | 130 | Example of the invention |

(Note 1): $D_m$, R, G, and B: In measuring the transmission density of each sample strip, the density of the unexposed portion, that is, the density of the maximum density portion, was designated as $D_m$. R, G, and B in the table stand for the values of $D_m$ measured by red light, green light, and blue light, respectively.

(Note 2): Sharpness was determined as follows: when the rectangular wave frequency response of the density measurement by green light at a frequency of 0 l/mm was designated 100, the response values at 20 l/mm and 30 l/mm are shown as relative values.

(Note 3): Granularity was determined as follows: the sample was subjected to reversal color processing after uniform exposure to grey light, projected onto a screen at 10 X magnification by a projector, and the observer gradually went away from the screen. The granularity is shown by the distance from the screen where the projected patterns of the grains could not be observed by the naked eye. Thus, granularity is finer as the value is lower.

As is clear from the results of Runs 1, 2, and 3, in the case where the DIR compound was not used, sufficient coloring density was obtained when the fogging agent was in the developer or a fogging bath containing the fogging bath was separately employed, and the sharpness and granularity of color photographic images were normal. Furthermore, in Run 1 where the fogging agent (sodium borohydride) was not present, the color density of color images was reduced and the sharpness considerably reduced.

Note: In Experiment 1, while no sodium borohydride was present, the ethylenediamine in the color developer employed had a weak fogging effect. If ethylenediamine was not present, the coloring density was more reduced.

On the other hand, when the sample containing the DIR compound was subjected to processing I, the coloring density of the color images formed was insufficient, the sharpness thereof was insufficient and granularity was coarser. When the fogging agent was added to the developer (as illustrated in processing II), the aforesaid faults were considerably improved, but the degree of the improvements was inferior to that of Runs 1 and 2 which were conventional methods, that is, the presence of the DIR compound had a harmful influence on the color density, sharpness, and granularity of the color images formed. Therefore, it will be understood from the results of Run 5 that the DIR compounds are unsuitable for conventional reversal color development. On the other hand, when the color photographic materials containing the DIR compounds were processed in the fogging bath or in the presence of the fogging agent as shown in Run 6 according to the process of this invention, the sharpness, as well as the granularity, of the color images formed, was remarkably improved. The effects of this invention are brought about by the simultaneous use of: (i) a development carried out in the presence of the DIR compound, and (ii) a fogging bath used prior to the color development; the effects of this invention cannot be obtained by employing step (i) or step (ii) individually. The individual employment of step (i) or (ii) does not suggest the aforesaid effect of this invention.

Furthermore, as to the sharpness of color images by the multilayer effect, the sharpness of the color images in Run 6 was far superior to those in Run 1 and 2, which showed that the multilayer effect effectively obtained by the employment of the DIR compound. On the other hand, in Run 4 and 5, the color density was insufficient and hence the sharpness of the color images became lower in spite of the use of the DIR compound. Also, in Run 3, the sharpness of color images was better than in Run 2, which showed that the multilayer effect was not obtained without the presence of the DIR compound, even if the fogging bath was used.

While the invention has been described in detail and with reference to specific embodiments thereof, it will be apparent to one skilled in the art that various changes and modifications can be made therein without departing from the spirit and scope thereof.

What is claimed is:

1. A reversal color development process for silver halide reversal color photographic materials including a first development and a color development which comprises carrying out the first development in the presence of a DIR compound of the hydroquinone type which releases a diffusible mercapto development inhibitor or releases an iodine ion upon development of silver halide grains or upon reaction with oxidation product of a color developing agent formed upon development of silver halide, contacting the photographic materials with an aqueous solution of a fogging agent capable of chemically fogging the silver halide of the photographic materials, and then subjecting the photographic materials to the color development.

2. The reversal color development process as set forth in claim 1 in which the non-coupler type development inhibitor releasing compound is present in the photographic emulsion layer of the color photographic material.

3. The reversal color development process as set forth in claim 1 in which the aqueous solution of the fogging agent is an alkaline aqueous solution of an alkali metal salt of a borohydride, a compound represented by the formula $YBH_3$ wherein Y represents ammonia or an amine, a compound of the formula

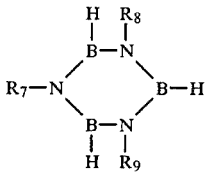

wherein $R_7$, $R_8$, and $R_9$ each represents a hydrogen atom, a halogen atom, an alkyl group or an alkoxy group, a polyborhydride represented by the formula $(L_{+n})_x(B_yH_z)^{-nx}$ wherein L represents an n-valent cation where n is an integer greater than 1, x is an integer greater than 1, y is an integer greater than 2 and z is an integer greater than 4, a stannous complex salt of an aminocarboxylic acid, a stannous chelate compound of an organic phosphorus compound, or a hydrazine compound.

4. The reversal color development process as set forth in claim 3, wherein n is 1–3, x is 1 or 2, y is 2–20 and z is 6–14.

5. The reversal color development process as set forth in claim 3, wherein Y is selected from the group consisting of methylamine, dimethylamine, triethylamine, ethylamine, ethanolamine, diethylamine, triethylamine, diethanolamine, propylamine, dipropylamine, butylamine, sec-butylamine, t-butylamine, and amylamine.

6. The reversal color development process as set forth in claim 3, wherein Y is selected from the group consisting of ethylenediamine and diethylenetriamine.

7. The reversal color development process as set forth in claim 1 in which the DIR compound is present in the first developer.

8. The reversal color development process as set forth in claim 1, wherein said fogging agent is selected from the group consisting of sodium borohydride, potassium borohydride, diethylamineborane, triethylamineborane, trimethylamineborane, t-butylamineborane, pyridineborane, 2,6-lutidineborane, ethylenediamineborane, hydrazineborane, dimethylphosphineborane, dimethylstibinborane, borazine, N,N',N''-trimethylborazine, N,N',N''-trimethoxyborazine, tetramethylammonium octahydrotriborate, ditetramethylammonium hexahydrodiborate, di-tetramethylammonium tetradecahydrodecaborate, trimethyloctadecylammonium octahydrotriborate, pyridinium octahydrotriborate, tetramethylphosphonium octahydrotriborate, trimethylsulfonium octahydrotriborate, disodium hexahydroborate, disodium tetradecahydrodecaborate, stannous ethylenediaminetetraacetate, disodium salt, stannous nitrilotriacetate, sodium salt, tin N-hydroxyethylenediamine triacetate, tin iminodiacetate, chelate compound of tin (II) and ethylenediamine-N,N,N',N'-tetramethylenephosphonic acid, chelate compound of tin (II) and nitrilo-N,N,N-trimethylenephosphonic acid, chelate compound of tin (II) and 1,2-cyclohexanediamine-N,N,N',N'-tetramethylenephosphonic acid, chelate compound of tin (II) and propylamino-N,N-dimethylenephosphonic acid, chelate compound of tin (II) and 4-(pyrrolidino)-butylamine-N,N-bis(methylenephosphonic acid, chelate compound of tin (II) and 1,3-diaminopropanol-N,N,N',N'-tetramethylenephosphonic acid, chelate compound of tin (II) and 1,3-propanediamine-N,N,N',N'-tetramethylenephosphonic acid, chelate compound of tin (II) and o-acetamidobenzylamino-N,N-dimethylenephosphonic acid, chelate compound of tin (II) and 2-pyridylamino-N,N'-dimethylenephosphonic acid, chelate compound of tin (II) and o-toluidine-N,N-dimethylenephosphonic acid, chelate compound of tin (II) and 1-hydroxyethylidene-1,1-diphosphonic acid, chelate compound of tin (II) and ethylidene-1,1,1-triphosphonic acid, chelate compound of tin (II) and 1-hydroxypropylidene-1,1-diphosphonic acid, ethylenediamineborane, and hydrazineborane.

9. The reversal color development process as set forth in claim 1, wherein said DIR compound is present in said first developer in an amount of about 1/3000 to about 1/10 mole, per mole of coupler in the silver halide reversal color photographic materials.

10. The reversal color development process as set forth in claim 1, wherein said DIR compound is present in a photographic emulsion of said silver halide reversal color photographic material in an amount of from about 1/400 to about ½ mole, per mole of coupler in the photographic emulsion.

* * * * *